US011465157B2

(12) United States Patent
Ribeiro et al.

(10) Patent No.: US 11,465,157 B2
(45) Date of Patent: Oct. 11, 2022

(54) MAGNETIC SEPARATORS WITH STATIONARY MAGNETIC MATRICES, AND METHODS OF USING THE SAME

(71) Applicants: Cláudio Henrique Teixeira Ribeiro, Ellicott City, MD (US); José Pancrácio Ribeiro, Nova Lima (BR)

(72) Inventors: Cláudio Henrique Teixeira Ribeiro, Ellicott City, MD (US); José Pancrácio Ribeiro, Nova Lima (BR)

( * ) Notice: Subject to any disclaimer, the term of this patent is extended or adjusted under 35 U.S.C. 154(b) by 162 days.

(21) Appl. No.: 16/928,495

(22) Filed: Jul. 14, 2020

(65) Prior Publication Data

US 2022/0016638 A1 Jan. 20, 2022

(51) Int. Cl.
*B03C 1/08* (2006.01)
*B03C 1/029* (2006.01)
*B03C 1/033* (2006.01)

(52) U.S. Cl.
CPC ..... *B03C 1/08* (2013.01); *B03C 1/029* (2013.01); *B03C 1/0332* (2013.01); *B03C 1/0335* (2013.01)

(58) Field of Classification Search
CPC ..... B03C 1/034; B03C 1/035; B03C 2201/22; B03C 1/08; B03C 1/29; B03C 1/0332; B03C 1/0335; B03C 1/032
See application file for complete search history.

(56) References Cited

U.S. PATENT DOCUMENTS 2,056,426 A 10/1936 Frantz
3,346,116 A 10/1967 Jones
3,770,629 A 11/1973 Nolan
3,830,367 A 8/1974 Stone
3,988,240 A * 10/1976 Fraas ..... B03C 1/03 209/217
4,235,710 A 11/1980 Sun
4,874,508 A * 10/1989 Fritz ..... B03C 1/03 209/214
5,932,096 A * 8/1999 Saho ..... B03C 1/027 210/208

(Continued)

FOREIGN PATENT DOCUMENTS

GB 768451 2/1957
WO 2010/054847 A1 5/2010

OTHER PUBLICATIONS

International Search Report dated Jun. 11, 2021 for International Patent Application No. PCT/IB21/52040 (2 pages).

(Continued)

*Primary Examiner* — Patrick H Mackey
(74) *Attorney, Agent, or Firm* — Smith, Gambrell & Russell, LLP

(57) ABSTRACT

A magnetic separator and methods of use are provided for continuous feeding of a material feed flow at high production feed rates without rotation of large heavy steel parts through high intensity magnetic fields. The magnetic separators use stationary magnetic matrices and redirect a material feed flow and a flushing fluid flow between the stationary magnetic matrices. Magnetic fields within the stationary magnetic matrices are modulated based on reception of a material feed flow or a flushing fluid flow to optimize separation processes and purging processes. The magnetic separators also collect and direct the separated components to isolated collection sites.

32 Claims, 16 Drawing Sheets

(56) References Cited

U.S. PATENT DOCUMENTS

| | | | | |
|---|---|---|---|---|
| 5,944,986 | A | 8/1999 | Saho et al. | |
| 8,292,084 | B2 * | 10/2012 | Chappie | B03C 1/30 209/225 |
| 9,469,555 | B2 * | 10/2016 | Predescu | B03C 1/0335 |

OTHER PUBLICATIONS

Written Opinion dated Jun. 11, 2021 for International Patent Application No. PCT/IB21/52040 (4 pages).

* cited by examiner

MAGNETIC SEPARATORS WITH STATIONARY MAGNETIC MATRICES, AND METHODS OF USING THE SAME

FIELD OF THE INVENTION

The present invention relates to apparatuses and methods for magnetic separation of a material feed to separate magnetic and non-magnetic particles. In particular, the present invention is inclusive of magnetic separating systems in which magnetic matrices are held stationary while a material feed flow is varied between separate magnetic matrices, and methods of operating such systems in the magnetic separation of material feeds.

BACKGROUND OF THE INVENTION

Magnetic separator systems are well-known for separating magnetic and non-magnetic components, with the purpose of isolating the separated components for subsequent manufacturing purposes. Examples of conventional magnetic separators are described in U.S. Pat. No. 2,056,426 (Frantz); U.S. Pat. No. 4,235,710 (Sun); U.S. Pat. No. 3,346,116 (Jones); U.S. Pat. No. 3,830,367 (Stone) and WO2010/054847A1 (Ribeiro, et al.), the entire contents and disclosures of each of which are incorporated herein by reference.

Prior conventional magnetic separators can be divided into two groups—(1) small scale machines for laboratory test work, research, and limited-volume production of high valuable materials; and (2) large scale machines for the separation of manufacturing materials for mass-volume production of low-priced commodities. Examples of materials separated for production of low-priced commodities include mineral oxides of iron, manganese and phosphates, to name a few.

In the field of mass-volume production of low-priced commodities, economic viability typically requires that these materials be produced in a range of hundreds or thousands of tons per hour, with continuous operation of the system. Conventionally, these large-scale systems operate with large rotors that are driven to transport magnetic matrices that receive and carry a slurry through a magnetic field for separation of magnetic and non-magnetic components of the slurry.

Though conventional magnetic separators have proven effective, they nonetheless present a number of inefficiencies and shortcomings. For example, rotation of the rotors through the magnetic field in those conventional systems requires high precision motors, gearboxes, and shafts; and places a high work load on those components with large power consumption, investment, and maintenance costs. In addition, those conventional systems are generally made with the magnetic matrices integrally mounted in the rotor, which makes it difficult, if not impossible, to make mechanical adjustments to the matrices to adapt the system to changing operational circumstances.

Thus, despite the advances provided to date in the art, there remains a need for improvements to magnetic separators for yet further advancing the state of the art, and improving the overall efficiency and operability of such systems generally.

SUMMARY OF THE INVENTION

A magnetic separator comprises at least one pair of magnetic sieves, including a first magnetic sieve and a second magnetic sieve, supported in stationary positions on a static platform; at least one pair of flow distributors, comprising a first distributor in a downstream flow of the first magnetic sieve and a second distributor in a downstream flow of the second magnetic sieve; a material flow diffusor for supplying a material feed flow from a material supply line and a flushing fluid flow from a flushing manifold, the material flow diffusor being configured to supply the material feed flow and the flushing fluid flow to both the first magnetic sieve and the second magnetic sieve; and a controller configured to: feed a material feed flow to the pair of magnetic sieves during a production run for separating magnetic and non-magnetic components in the material feed flow, with the material feed flow being fed to the pair of magnetic sieves in a continuous flow, and to switch the material feed flow between the first magnetic sieve and the second magnetic sieve without interrupting the continuous flow; control a power supply to the pair of magnetic sieves for generating magnetic fields within the pair of magnetic sieves for separation of magnetic and non-magnetic components in a material feed flow that is fed to the pair of magnetic sieves; control the flow distributors to switch each flow distributor between a first output position for discharging a non-magnetic product flow and a second position for discharging a magnetic product flow.

The controller is configured to control the material feed flow to flow to only one of the first magnetic sieve and the second magnetic sieve; and to control the material feed flow to switch between the first magnetic sieve and the second magnetic sieve while maintaining a constant flow rate of the continuous flow. The controller is further configured to control the pair of magnetic sieves such that one magnetic sieve performs magnetic separation in a feeding operation and the other magnetic sieve performs product purging in a flushing operation to purge separated material in the absence of a material feed flow, with the magnetic separation in the one magnetic sieve and the product purging in the other magnetic sieve being performed in parallel with one another.

The controller is further configured to control the power supply to the pair of magnetic sieves such that: one magnetic sieve receiving the material feed flow for performing magnetic separation is provided with sufficient power to generate a magnetic field suitable for separating magnetic components in the material feed flow from non-magnetic components in the material feed flow; and another magnetic sieve receiving the flushing fluid flow for performing product purging is provided with a relatively lesser power than that provided to the one magnetic sieve to enable purging of magnetic components by the flushing fluid flow.

The controller is configured to control the power supply to the pair of magnetic sieves such that, prior to switching the material feed flow from one magnetic sieve to another, a power supply to the other magnetic sieve is increased to provide sufficient power to generate a magnetic field in the other magnetic sieve suitable for separating magnetic and non-magnetic components in the material feed flow; and after switching the material feed flow from the one magnetic sieve to the other, decreasing the power supply to the one magnetic sieve to sufficiently reduce a magnetic field in the one magnetic sieve to enable purging of magnetic components by a flushing fluid flow. In some examples, the controller may eliminate the power supply to the magnetic sieve receiving the flushing fluid flow for performing product purging; and in some examples the controller may make a predetermined reduction in the power supply to the magnetic sieve receiving the flushing fluid flow for performing product purging.

Magnetic separators according to the present invention further comprise at least one product receptacle in a downstream flow with at least one flow distributor for receiving material flows from the at least one flow distributor, the product receptacle comprising a first section for receiving non-magnetic product and a second section for receiving magnetic product. In some examples, the magnetic separator comprises at least one pair of product receptacles comprising a first product receptacle in a downstream flow with the first flow distributor and a second product receptacle in a downstream flow with the second flow distributor, the first and second product receptacles each comprising a first section for receiving non-magnetic product and a second section for receiving magnetic product.

In some examples, the material flow diffusor comprises a feed inlet in a downstream flow with the material supply line for receiving a material feed flow, the feed inlet being movable between a first position for dispensing a material feed flow to the first magnetic sieve and a second position for dispensing a material feed flow to the second magnetic sieve. The feed inlet is supported on a pair of tracks, and the controller is configured to command an actuator for moving the feed inlet along the pair of tracks, between the first and second positions, to switch a material feed flow between the first magnetic sieve and the second magnetic sieve.

The material flow diffusor further comprises a pair of flush inlets in downstream flow with the flushing manifold for receiving a flushing fluid flow, the pair of flush inlets being movable between first and second positions; and the controller is configured to command an actuator for moving the pair of flush inlets between the first and second positions for executing flushing operations to purge material from the pair of magnetic sieves. The pair of flush inlets comprise a first flush inlet and a second flush inlet, where in a first position the first flush inlet is positioned for dispensing a flushing fluid flow to the first magnetic sieve and in a second position the second flush inlet is positioned for dispensing a flushing fluid flow to the second magnetic sieve; and the controller is configured to command an actuator for moving the pair of flush inlets between the first and second positions for executing flushing operations to purge material from the pair of magnetic sieves.

In some examples, the feed inlet and the pair of flush inlets are supported on a pair of tracks, and each is reciprocally movable along the tracks; and the controller is configured to command an actuator for moving the feed inlet and pair of flush inlets along the tracks such that: in a first position, the feed inlet is positioned for dispensing a material feed flow to the first magnetic sieve, and the second flush inlet is positioned for dispensing a flushing fluid flow to the second magnetic sieve, and in a second position, the feed inlet is positioned for dispensing a material feed flow to the second magnetic sieve, and the first flush inlet is positioned for dispensing a flushing fluid flow to the first magnetic sieve.

In some examples, the material flow diffusor comprises a pair of flush inlets in downstream flow with the flushing manifold for receiving a flushing fluid flow, the pair of flush inlets comprising a first flush inlet and a second flush inlet, with the first flush inlet movable along a length of the first magnetic sieve and the second flush inlet movable along a length of the first magnetic sieve; and the controller is configured to command an actuator for moving the pair of flush inlets along lengths of the respective magnetic sieves to execute flushing operations to purge material from the pair of magnetic sieves. The pair of flush inlets are supported on respective support arms and suspended over respective openings to the corresponding magnetic sieves; and the controller is configured to command an actuator to reciprocally move the pairs of support arms along lengths of the respective magnetic sieves to execute the flushing operations.

In some examples, the material flow diffusor comprises a silo in downstream flow with the material supply line for receiving a material feed flow, and a pair of feed inlets in downstream flow with the silo, the pair of feed inlets comprising a first feed inlet for dispensing a material feed flow to the first magnetic sieve and a second feed inlet for dispensing a material feed flow to the second magnetic sieve; and the controller is configured to switch a material feed flow between the first magnetic sieve and the second magnetic sieve by controlling at least one actuator on the silo for changing the material feed flow between the first feed inlet and the second feed inlet.

The silo may include a movable silo chute in downstream flow with an output of the material supply line, the silo chute being movable between a first portion for directing a material feed flow to the first feed inlet and a second position for directing a material feed flow to the second feed inlet; and the controller is configured to command an actuator for moving the silo chute between the first position and the second position to switch a material feed flow between the first magnetic sieve and the second magnetic sieve.

The silo may also include a first funnel having a first rotary valve and a second funnel having a second rotary valve; and the controller is configured to command an actuator to the first rotary valve for opening and closing a passage for a material feed flow through the first funnel, and to command an actuator to the second rotary valve for opening and closing a passage for a material feed flow through the second funnel, the controller being programmed to control the respective actuators of the first and second rotary valves to open a passage through only one of the first and second funnels at a time. A first dosing mechanism is provided downstream of the first rotary valve, the first dosing mechanism being adapted to control a dosing rate of a material feed flow to the first feed inlet for dispensing to the first magnetic sieve; a second dosing mechanism is provided downstream of the second rotary valve, the second dosing mechanism being adapted to control a dosing rate of a material feed flow to the second feed inlet for dispensing to the second magnetic sieve; and the controller is configured, when commanding an actuator of a rotary valve to move the corresponding rotary valve to an open state, to control a dosing rate of the corresponding dosing mechanism downstream of the respective rotary valve.

In some examples, the material flow diffusor further comprises a pair of flush inlets in downstream flow with the flushing manifold for receiving a flushing fluid flow, the pair of flush inlets comprising a first air nozzle for injecting an airflow into the first magnetic sieve and a second air nozzle for injecting an airflow into the second magnetic sieve; and the controller is configured, when directing a material feed flow to a magnetic sieve, to command the corresponding air nozzle of the respective magnetic sieve to inject an air flow into the magnetic sieve for creating a pressure differential that promotes a flow of the material feed flow through the magnetic sieve.

In some examples, the first magnetic sieve comprises a first funnel in downstream flow with the first magnetic sieve for receiving a material feed flow output from the first magnetic sieve, and the second magnetic sieve comprises a second funnel in downstream flow with the second magnetic sieve for receiving a material feed flow output from the second magnetic sieve; a first exhaust fan is provided in airflow communication with the first funnel for ejecting air from the first funnel to create a negative pressure within the first funnel, and a second exhaust fan is provided in airflow communication with the second funnel for ejecting air from the first funnel to create a negative pressure within the second funnel; and the controller is configured, when directing a material feed flow to a magnetic sieve, to command the corresponding exhaust fan downstream of the respective magnetic sieve to eject air from the corresponding funnel to create a negative pressure within the corresponding funnel downstream of the magnetic sieve for creating a pressure differential that promotes a flow of the material feed flow through the magnetic sieve and into the funnel.

A plurality of magnetic separators according to the present invention may be joined with one another to form a magnetic separator assembly in which the plurality of magnetic separators are positioned adjacent one another, in a circular arrangement with feed inlets of the plurality of magnetic separators in downstream flow with a common material supply line and flush inlets of the plurality of magnetic separators in downstream flow with a common flushing manifold.

A plurality of magnetic separator assemblies according to the present invention may be joined with one another to form a multi-tier magnetic separator assembly in which the plurality of magnetic separator assemblies are stacked one atop another, with the feed inlets of the plurality of magnetic separators in downstream flow with a common material supply line and the flush inlets of the plurality of magnetic separators in downstream flow with a common flushing manifold.

BRIEF DESCRIPTION OF THE DRAWINGS

Further features and advantages of the invention can be ascertained from the following detailed description that is provided in connection with the drawings described below.

DETAILED DESCRIPTION OF THE INVENTION

Figure 1:
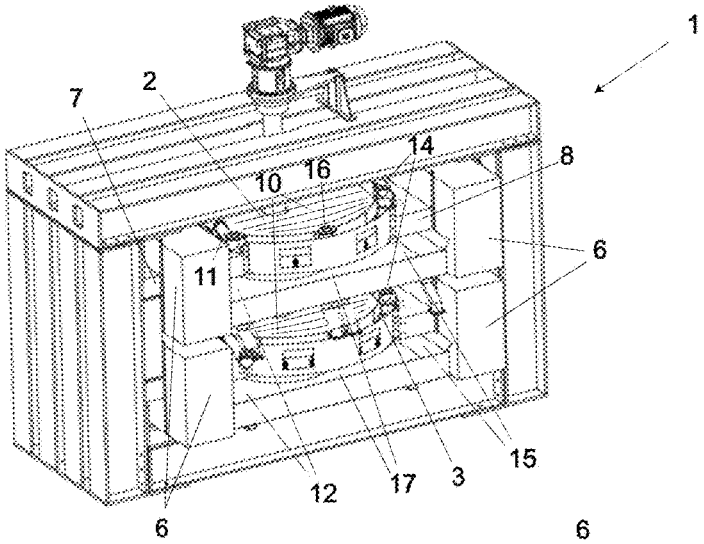
FIG. 1 shows a conventional magnetic separator.

The following disclosure discusses the present invention with reference to the examples shown in the accompanying drawings, though does not limit the invention to those examples.

The use of any and all examples, or exemplary language (e.g., "such as") provided herein is intended merely to better illuminate the invention and does not pose a limitation on the scope of the invention unless otherwise claimed. No language in the specification should be construed as indicating any non-claimed element as essential or otherwise critical to the practice of the invention. Unless made clear in context, As used herein, the singular forms "a," "an," and "the" include plural referents unless the context clearly dictates otherwise. Unless indicated otherwise by context, the term "or" is to be understood as an inclusive "or." Terms such as "first", "second", "third", etc. when used to describe multiple devices or elements, are so used only to convey the relative actions, positioning and/or functions of the separate devices, and do not necessitate either a specific order for such devices or elements, or any specific quantity or ranking of such devices or elements.

The word "substantially", as used herein with respect to any property or circumstance, refers to a degree of deviation that is sufficiently small so as to not appreciably detract from the identified property or circumstance. The exact degree of deviation allowable in a given circumstance will depend on the specific context, as would be understood by one having ordinary skill in the art.

Use of the terms "about" or "approximately" are intended to describe values above and/or below a stated value or range, as would be understood by one having ordinary skill in the art in the respective context. In some instances, this may encompass values in a range of approx. +/−10%; in other instances there may be encompassed values in a range of approx. +/−5%; in yet other instances values in a range of approx. +/−2% may be encompassed; and in yet further instances, this may encompass values in a range of approx. +/−1%.

It will be understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof, unless indicated herein or otherwise clearly contradicted by context.

Recitations of a value range herein, unless indicated otherwise, serves as a shorthand for referring individually to each separate value falling within the stated range, including the endpoints of the range, each separate value within the range, and all intermediate ranges subsumed by the overall range, with each incorporated into the specification as if individually recited herein.

Unless indicated otherwise, or clearly contradicted by context, methods described herein can be performed with the individual steps executed in any suitable order, including: the precise order disclosed, without any intermediate steps or with one or more further steps interposed between the disclosed steps; with the disclosed steps performed in an order other than the exact order disclosed; with one or more steps performed simultaneously; and with one or more disclosed steps omitted.

Figure 2:
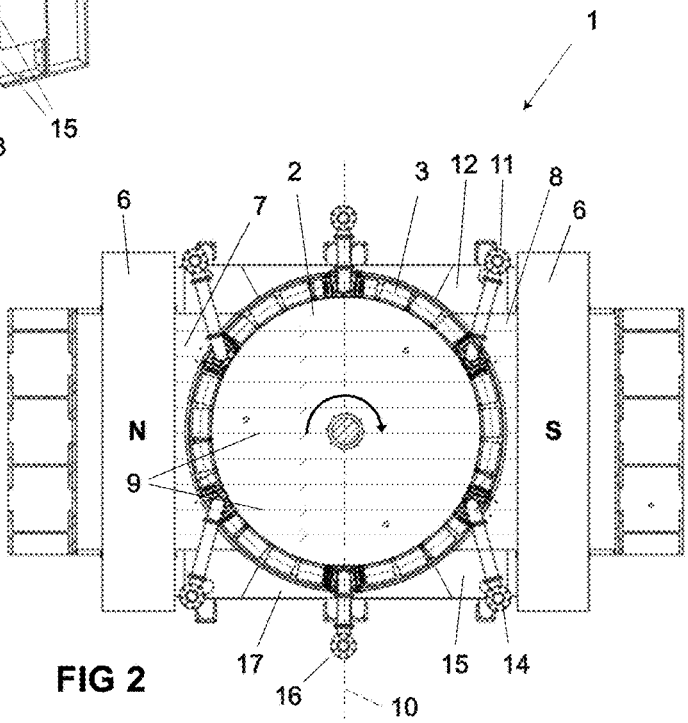
FIG. 2 shows a top-down cross-section view of the magnetic separator of FIG. 1.
Figure 3:
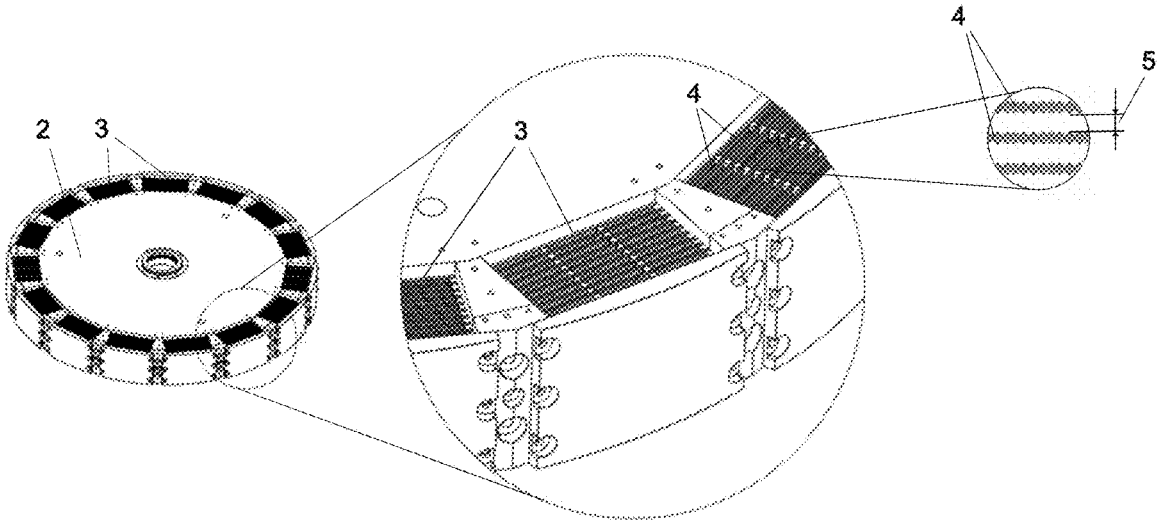
FIG. 3 shows a rotor and magnetic matrix of the magnetic separator of FIG. 1.

FIGS. 1-3 illustrate a conventional magnetic separator 1, such as that disclosed in U.S. Pat. No. 3,830,367 (Stone), which is operable to separate magnetic and non-magnetic components in a wet-process. The system 1 has a housing in which there is provided a steel rotor 2, in the form of a heavy disc surrounded by a series of magnetic matrices 3. Each individual magnetic matrix 3 is formed with a plurality of grooved plates 4, with each of the plurality of plates 4 separated from one another by a series of gaps 5 that extend entirely vertically through the matrix 2. FIG. 3 shows one example of a conventional rotor 2 in which a plurality of magnetic matrices 3 are formed monolithically around a circumference of the rotor 2, with each matrix 3 comprising a plurality of grooved plates 4.

As seen in FIGS. 1-2, a pair of diametrically opposed heavy steel pieces 7/8 are provided with electromagnetic coils 6 to form a north magnetic pole 7 and a south magnetic pole 8 positioned adjacent to and at opposing sides of the rotor 2. With this arrangement, there is formed a strong magnetic field 9 between the opposing north and south poles 7/8, with the magnetic field 9 extending through the rotor 2 and the gaps 5 of the matrices 3 where magnetic separation takes place.

In operation, rotor 2 is rotated in a clockwise direction so that each matrix 3 passes under a slurry inlet 11 that is positioned proximate a leading edge of the south magnetic pole 8. As each matrix 3 passes under the slurry inlet 11, a slurry is fed from the inlet 11 into an upper end of the matrix 3, and through gaps 5 between grooved plates 4 thereof. The slurry fed is a semi-liquid mixture comprising magnetic and non-magnetic particles suspended in a liquid medium. Owing to the strong magnetic field 9, magnetic particles in the slurry immediately adhere to ridges in the surfaces of the grooved plate 4, while non-magnetic particles continue to pass through the gaps 5, falling out a lower end of the matrix 3, into a collecting launder 12 positioned beneath the rotor 2, for separate collection as non-magnetic product.

As the rotor 2 continues to rotate clockwise, after passing under the slurry inlet 11, each matrix 3 subsequently passes under a low-pressure flushing inlet 14 that is positioned proximate to a trailing edge of the south magnetic pole 8. As each matrix 3 passes under the low-pressure flushing inlet 14, a low-pressure flushing liquid is fed from the inlet 14 into the upper end of the matrix 3, and through gaps 5 between plates 4 thereof. Introduction of the low-pressure flushing liquid removes non-magnetic particles that were trapped in the matrix 3 by magnetic particles that adhered to the surfaces of the grooved plates 4. The low-pressure flushing liquid and non-magnetic particles removed thereby flow through the gaps 5, falling out the lower end of the matrix 3, into a collecting launder 15 positioned beneath the rotor 2, for separate collection as a middling product.

As the rotor 2 continues to rotate clockwise, after passing under the low-pressure flushing inlet 14, each matrix 3 subsequently passes under a high-pressure flushing inlet 16 that is positioned approximately along a neutral line 10 that is equidistant between the north and south magnetic poles 7/8. The neutral line 10 represents a region with substantially zero magnet field. As each matrix 3 passes under the high-pressure flushing inlet 16, a high-pressure flushing liquid is fed from the inlet 16 into the upper end of the matrix 3, and through gaps 5 between plates 4 thereof. Delivery of this high-pressure liquid removes the magnetic particles from the now demagnetized grooved plates 4, with the high-pressure flushing liquid and magnetic particles removed thereby flowing through the gaps 5, falling out the lower end of the matrix 3, into a collecting launder 17 positioned beneath the rotor 2, for separate collection as a magnetic product.

As the rotor 2 continues to rotate clockwise, after passing under the high-pressure flushing inlet 16, the foregoing process described relative to the south magnetic pole 8 is then repeated at the north magnetic pole 7, with a slurry inlet positioned at a leading edge of the north magnetic pole 7, a low-pressure flushing inlet positioned at a trailing edge of the north magnetic pole 7, and a high-pressure flushing inlet positioned approximately along an opposite end of the neutral line 10. With this arrangement, the system 1 is adapted so that each matrix 3 may be used to complete two separation cycles over the course of each full revolution of the rotor 2.

As described above, the system 1 requires rotation of the rotor 2, with the matrices 3 formed therein, through two powerful magnetic fields in order to collect magnetic particles on the surfaces of the grooved plates 4 under the influences of the strong magnetic fields and to then discharge the magnetic particles under a substantially zero magnetic influence in regions between the two magnetic fields. This rotation of the rotor 2 through such powerful magnetic fields places a high workload on the system 1, and incurs considerable shortcomings in the operation thereof.

The present invention provides high intensity magnetic separators that can operate continuously at high production feed rates without rotation of any large heavy steel parts through high intensity magnetic fields. Instead, systems according to the present invention use stationary magnetic matrices and redirect a material feed flow and a washing fluid flow relative to those stationary magnetic matrices. This is in sharp contrast to conventional magnetic separators, which use high-load mechanical components to rotate heavy steel rotors to transport magnetic matrices through powerful magnetic fields.

Magnetic separators according to the present invention are also adapted to modulate magnetic fields within the magnet matrices to optimize separation process, and to adjust several other process parameters such as the material feed flow rate, material feed resident time inside the magnetic matrices, and washing fluid flow pressure, to name a few. Magnetic separators according to the present invention are also operable to collect and direct the separated components to isolated collection sites.

Figure 4:
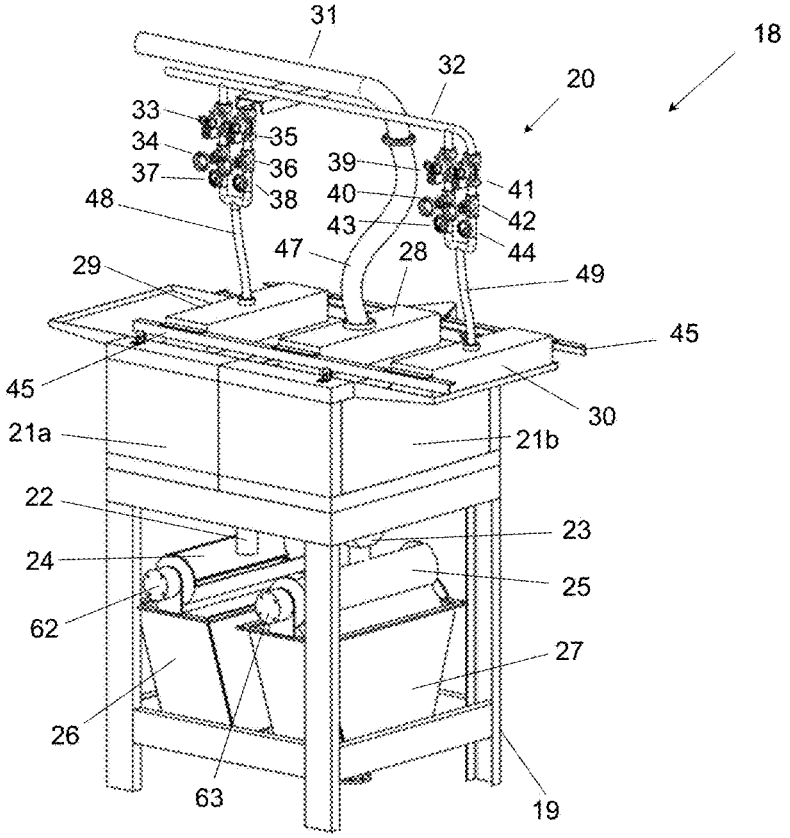
FIG. 4 shows one example of a magnetic separator according to the present invention.
Figure 5:
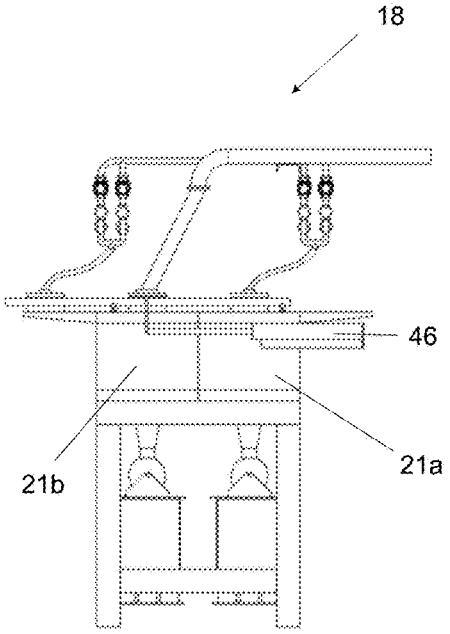
FIG. 5 shows a rear-elevation view of the magnetic separator of FIG. 4.
Figure 6:
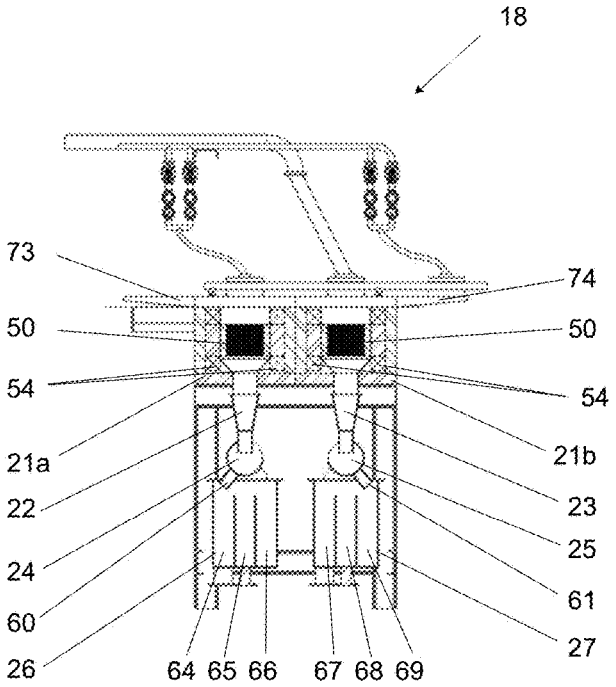
FIG. 6 shows a front elevation cross-section view of the magnetic separator of FIG. 4.
Figure 7:
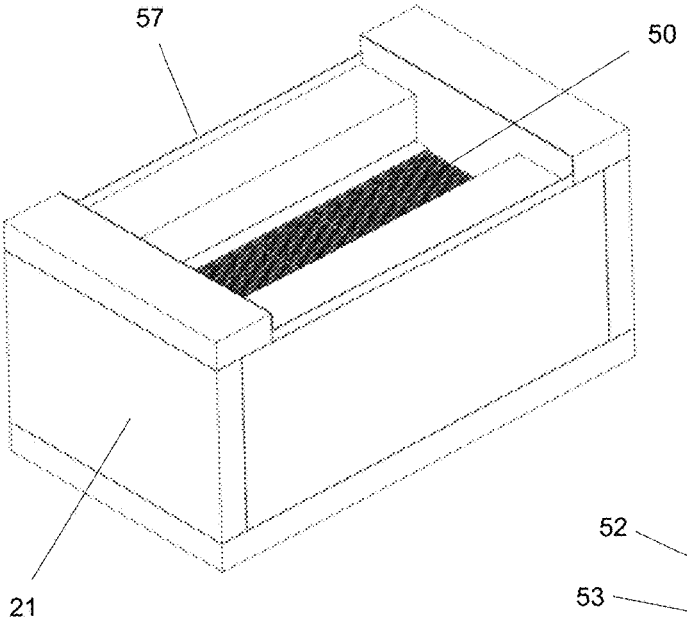
FIG. 7 shows a magnetic sieve of the magnetic separator of FIG. 4.
Figure 8:
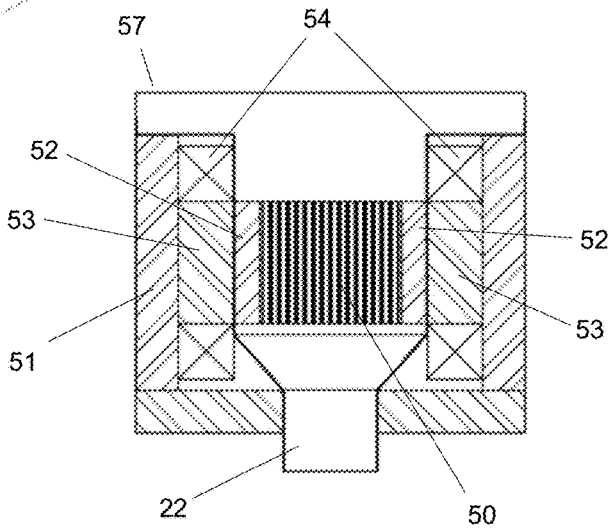
FIG. 8 shows a width cross-section view of the magnetic sieve of FIG. 7.
Figure 9:
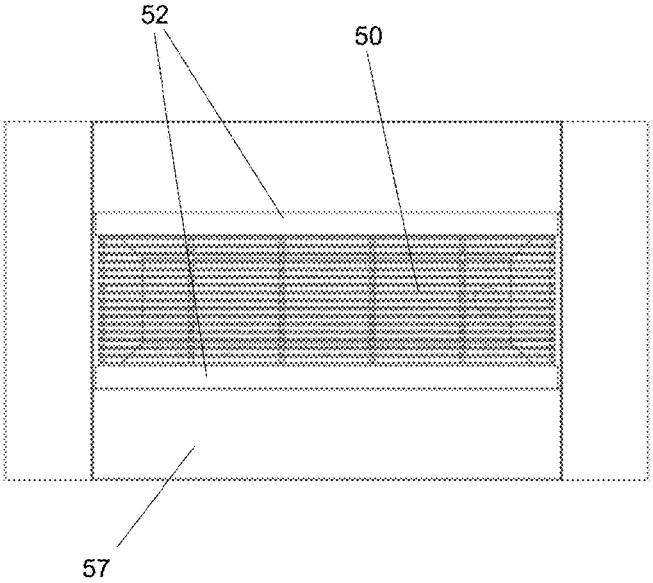
FIG. 9 shows a top plan view of the magnetic sieve of FIG. 7.

FIGS. 4-6 show one example of a magnetic separator 18 according to the present invention. In the illustrated example, the magnetic separator 18 includes a platform 19 and a diffusor 20 supported thereabove. Platform 19 supports two magnetic sieves 21*a*/21*b*, each having a funnel 22/23 for fluid communication with a respective distributor 24/25 for feeding output products to respective chutes 26/27. The diffusor 20 supported above platform 19 includes three separate ejectors 28-30 positioned above the magnetic sieves 21*a*/21*b*, and spaced laterally adjacent one another. Ejectors 28-30 include a single feed inlet 28 that receives a slurry from a slurry line 31 and two flush inlets 29/30 that receive a flushing fluid from a flushing manifold 32.

Flush inlet 29 is supplied with a flushing fluid that is separately controlled, in a first mode by a switching valve 33 and a regulating valve 34 for the flushing of a middling product, and in a second mode by a switching valve 35 and a regulating valve 36 for the flushing of a magnetic product. Pressure meters 37 and 38 provide information for use in adjusting the separate flushing fluid flows, with pressure meter 37 positioned to provide pressure information of a middling-product flushing flow in the first mode and pressure meter 38 positioned to provide pressure information of a magnetic-product flushing flow in the second mode.

In similar fashion, flush inlet 30 is supplied with flushing fluid that is separately controlled, in a first mode by a switching valve 39 and a regulating valve 40 for the flushing of a middling product, and in a second mode by a switching valve 41 and a regulating valve 42 for the flushing of a magnetic product. Pressure meters 43 and 44 provide information for use in adjusting the separate flushing fluid flows, with pressure meter 43 positioned to provide pressure information of a middling-product flushing flow in the first mode and pressure meter 44 positioned to provide pressure information of a magnetic-product flushing flow in the second mode.

Ejectors 28-30 are mounted on a pair of tracks 45, with feed inlet 28 positioned centrally and flush inlets 29/30 positioned to the adjacent left and right sides thereof. Ejectors 28-30 are movable laterally along the tracks 45 under power of a two-position actuator 46, as seen in FIG. 5. Movable feed inlet 28 is kept in fluid communication with the fixed slurry line 31 by a flexible hose 47, and flush inlets 29/30 are kept in fluid communication with the flushing manifold 32 through respective flexible hoses 48/49.

Figure 10:
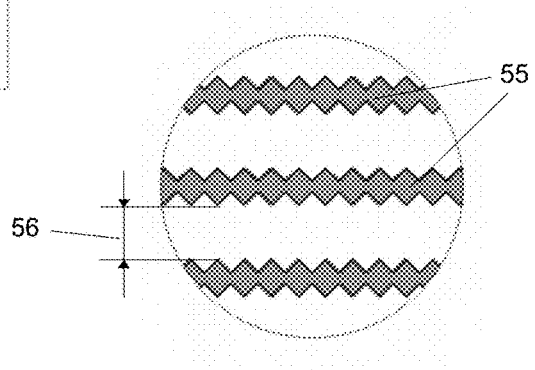
FIG. 10 shows a close-up view of the plates and gaps in the magnetic sieve of FIG. 7.
Figure 11:
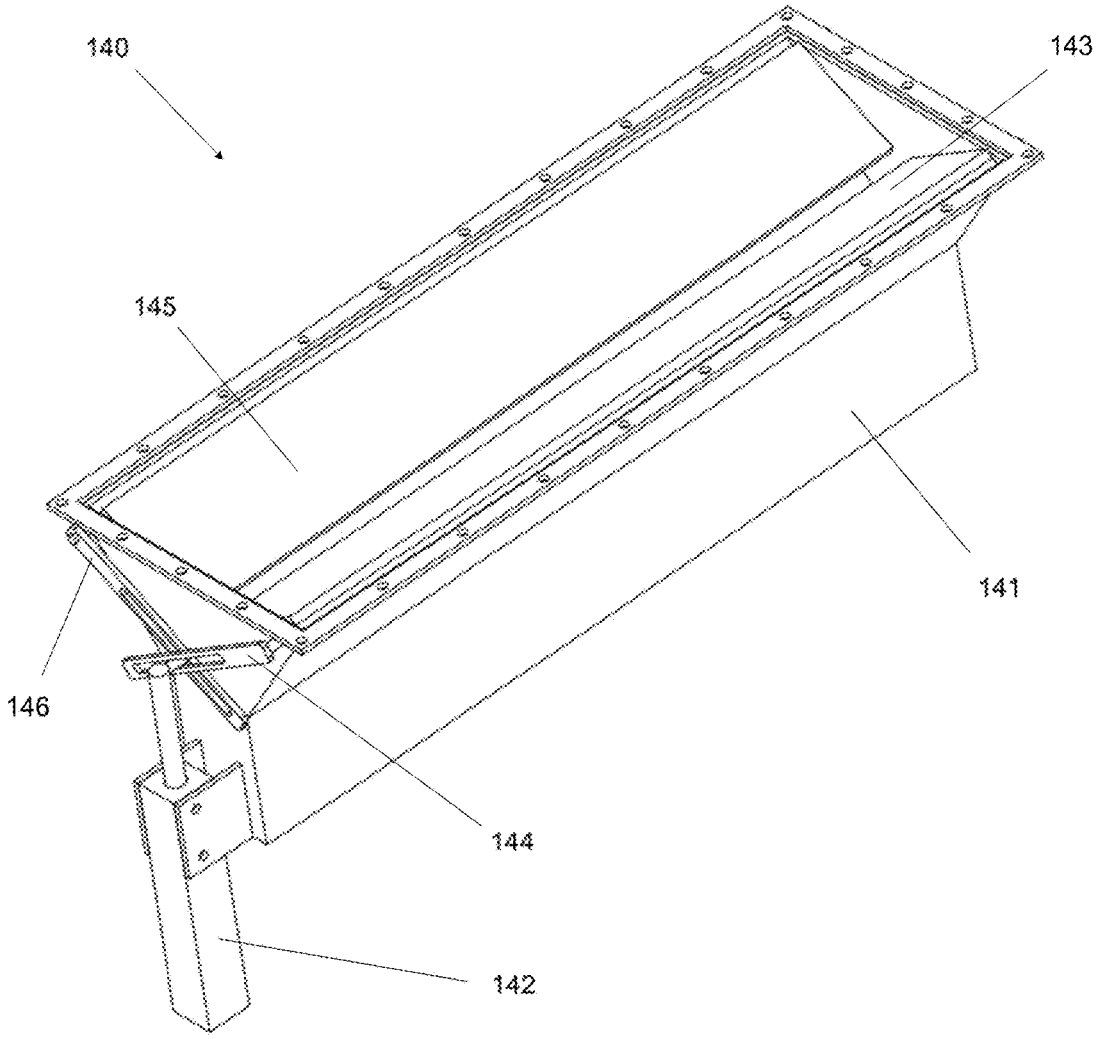
FIG. 11 shows an example of a discharge gate for the magnetic sieve of FIG. 7.

FIGS. 7-12 show examples of a magnetic sieve 21 for use in the magnetic separator 18, as well as all other separator systems further disclosed herein. The magnetic sieve 21 includes a magnetic matrix 50 housed within a matrix frame 51, and mounted on two shims 52 so as to be positioned centrally between two opposing magnetic pole pieces 53. Electromagnetic coils 54 are wound around the opposing magnetic pole pieces 53 for generating a magnetic field therein. As shown in FIG. 10, the magnetic matrix 50 has a plurality of grooved plates 55, each of which are separated from one another by a series of gaps 56 that extend entirely vertically through the matrix 50. A trough 57 is provided at a top end of the matrix frame 51 for guiding material flows (slurry; flushing fluid) to the magnetic matrix 50 therein; and a funnel 22/23 is provided at a bottom end of the frame 51 for guiding material flows from the matrix 50 to a distributor 24/25.

In addition to housing and supporting the magnetic matrix 50 between the opposing magnetic pole pieces 53, the matrix housing 51 and shims 52 are made of magnetic conductive material and act as conductors to close a magnetic circuit between the matrix 50 and the poles 53. In some examples, the matrix housing 51 and shims 52 may be permanent magnets, so as to provide enhanced efficiency and/or reduced power consumption. In examples using permanent magnets, the permanent magnets are provided with a switch for controlling the flow of the magnetic field in two directions, including a first direction where the magnetic field flows through the magnetic matrices 50 and a second direction in which the magnetic fields are directed away from the magnetic matrices 50, with the switch being controlled via the PLC 70. As another option, the permanent magnets may be provided with the electromagnetic coils, and power may be supplied to the electromagnetic coils for increasing and decreasing the magnetic field of the permanent magnets. The shims 52 and magnetic matrix 50 are adapted for optional removal from the matrix housing 50 to enable selective replacement with an alternate magnetic matrix 50' having a different configuration and/or dimensions, as well as an alternate set of shims 52 of different dimensions for supporting the alternate matrix 50'.

In operation, an electrical current to the electromagnetic coils 54 may be controlled and varied in a manner to generate variable magnetic field strengths in the magnetic matrix 50, with magnetic gradients in the gaps 56, thereby enabling fine tuning of the magnetic separation applied to various material flows that may be passed through the magnetic matrix 50. As the magnetic sieves 21*a*/21*b* are to be operated in opposite magnetic states, with one sieve (e.g., 21*b*) sufficiently powered to generate a magnetic field suitable for separating magnetic and non-magnetic components while the other sieve (e.g., 21*a*) is provided with reduced power (or no power) to permit purging of magnetic components, it is thus preferable that the pair of magnetic sieves be constructed with sufficient buffer therebetween to the generation of an induced magnetic field in the relatively depowered sieve as a result of the magnetic field generated in the adjacent sieve. Such a buffer may be provided, for example, by separating the two sieves by sufficient space to avoid such induction, or by inserting a non-magnetic barrier between the two sieves.

In some instances, the separator system may be intended for use in a process in which it is desirable to have a material feed flow that has passed through a sieve 21*a*/21*b* dwell or otherwise reside at a location within the system for a period of time (e.g., in a range of minutes) before passing to a material collection. Examples of such processes include, without limitation, the purification of kaolin or the purification of silica sand. In such processes where a residence time of a material feed flow is desirable, the funnel 22/23 may optionally be provided with or otherwise replaced by a dwelling mechanism, such as the discharge gate 140 shown in FIG. 11. In the illustrated example, the discharge gate 140 includes a gateway having a pair of flap 143/145 that are movable between an open position permitting the passage of a material flow through the gateway and into a downstream passage 141 (funnel 22/23) and a closed position that precludes the passage of a material flow therethrough. The flaps 143/145 are movable between the open and closed positons by a two-position actuator 142 having a stem that translates a linear movement to the flaps 143/145 through a pair of respective arms 144/146. Preferably, flaps 143/145 are coated with rubber or another material that provides a liquid-tight sealing when the flaps are moved to the closed position. In other examples the flaps 143/145 may be replaced by a single moving element, such as a single horizontally translating plate that is movable between open and closed position by a single arm in communication with the positon actuator 142.

Figure 12:
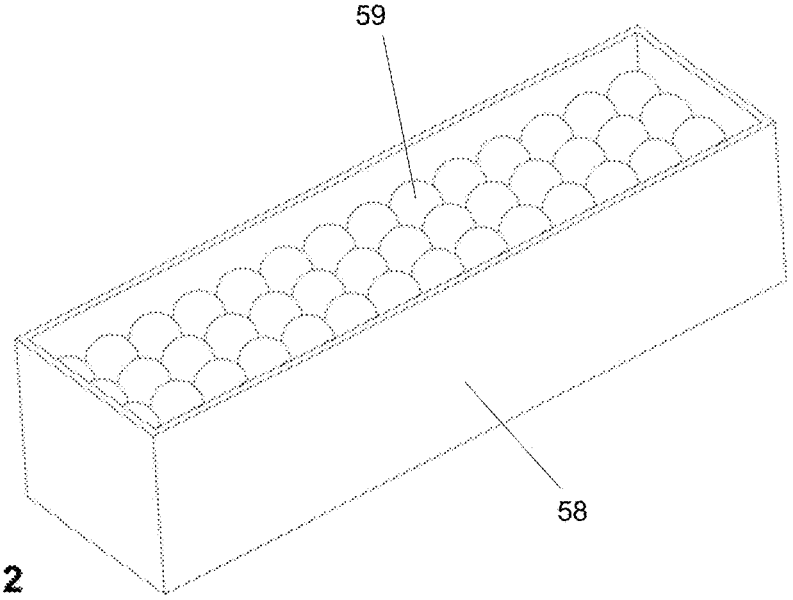
FIG. 12 shows another example of a magnetic matrix for the magnetic sieve of FIG. 7.

FIG. 12 shows one example of an alternative magnetic matrix 50' that may be substituted into the matrix frame 51 in the magnetic separator 18, as well as all other separator systems further disclosed herein, which may include use of shims 52 and matrices 50/50' that are adapted for optional removal and selective replacement. The magnetic matrix 50' comprises a container 58 that houses magnetic media 59, such as steel balls, expanded steel plates, steel wool, steel filaments, and the like, and any combinations thereof, that allows a material flow to freely pass through spaces between the magnetic media 59 while magnetic and non-magnetic particles are separated by magnetic gradients created within the magnetic media 59.

As seen in FIGS. 4-6, material flows that pass through the magnetic sieves 21*a*/21*b* passes to respective funnels 22/23 for delivery to respective distributors 24/25, with the distributors 24/25 then discharging the material flows to respective chutes 26/27. In the illustrated example, chutes 26/27 are provided as three-way chutes, and distributors 24/25 have respective moveable outlets 60/61 that switch between three positions for discharging flows to three separate channels in the respective chutes 26/27. Distributor 24 is driven by an actuator 62 for switching the moveable outlet 60 between three separate positions for discharging flows to separate channels 64-66 of three-way chute 26; and distributor 25 is driven by an actuator 63 for switching the moveable outlet 61 between three separate positions for discharging flows to separate channels 67-69 of three-way chute 27. In operation, distributor 24 may discharge magnetic product to channel 64, middling product to channel 65, and non-magnetic product to channel 66. Similarly, distributor 25 may discharge magnetic product to channel 67, middling product to channel 68, and non-magnetic product to channel 69.

Figure 13:
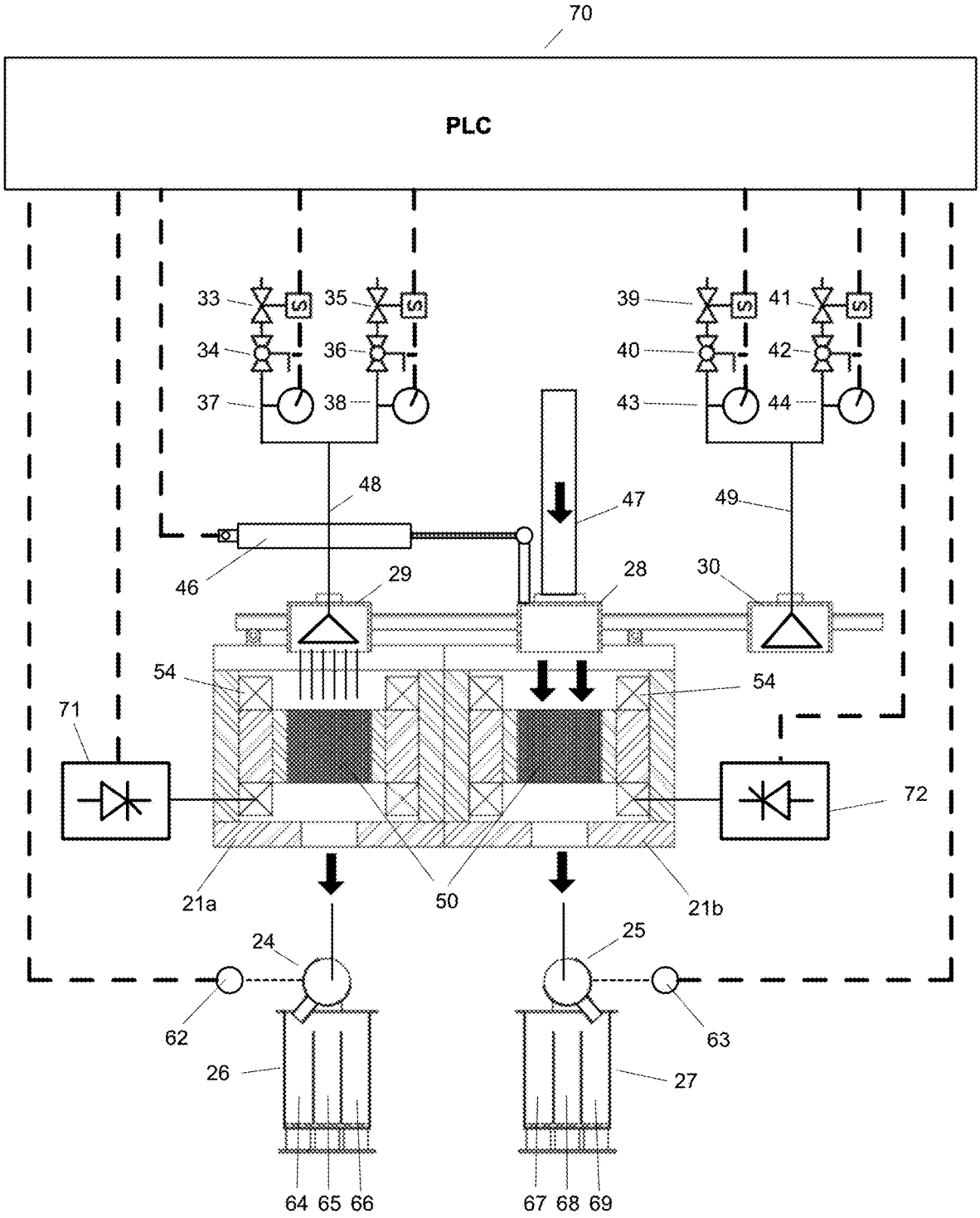
FIG. 13 shows a control scheme for the magnetic separator of FIG. 4.

FIG. 13 shows one example of a control scheme for a magnetic separator 18. As seen in the illustrated example, operation of the magnetic separator 18 may be controlled by a programmable logic controller (PLC) 70, which is in signal communication with the two-position actuator 46, the three-position actuators 62/63, the switching valves 33/35/39/41, and power supplies 71/72 for the electromagnetic coils 54. In the example shown in FIG. 13, regulating valves 34/36/40/42 and pressure valves 37/38/43/44 are also controlled by PLC 70; however, in some examples the regulating valves and/or pressure valves may each be manually controlled or adapted for both manual and PLC control. In magnetic separators that include a discharge gate 140, the PLC 70 is also in signal communication with the two-positon actuator 142 for controlling positioning of the flaps 143/145.

Unlike conventional systems, magnetic separator 18 is operable to separate material flows with magnetic matrices 50, housed in magnetic sieves 21*a*/21*b*, that are held stationary in static positions. This is made possible by instead effecting controlled movement of the ejectors 28-30, along tracks 45 by actuator 46, for adjusting relative positioning of the inlet feed 28 and flush inlets 29/30 for changing material flows through the stationary magnetic sieves 21*a*/21*b*. Operation of the magnetic separator 18 may be effected in this manner through cyclic movement of the ejectors 28-30, with additional control of the flush inlets 29/30 between multiple stages for effecting different modes of operation.

In operation, magnetic separator 18 repeatedly performs a number of slurry feed cycles, via feed inlet 28, with each slurry feed cycle including first and second stage operations in which a slurry feed is directed to two separate magnetic sieves 21*a*/21*b*. A first stage of a slurry feed cycle may begin, for example, with feed inlet 28 positioned over magnetic sieve 21*b* and flush inlet 29 positioned over magnetic sieve 21*a*. In such positioning, flush inlet 30 is positioned over a gutter 74 located adjacent an outer-side of the magnetic sieve 21*b* (see FIGS. 4-6). The PLC 70 controls the actuator 63 to adjust the moveable outlet 61 of distributor 25 to align with channel 69 of three-way chute 27. The PLC 70 also turns on power supply 72 to energize electromagnetic coils 54 to generate a magnetic field in the magnetic matrix 50, and the gaps 56 thereof, in magnetic sieve 21*b*. Under these conditions, a slurry flow that is being fed through slurry line 31, to flexible hose 47, and out from feed inlet 28, flows into sieve 21*b* for magnetic separation by the magnetized matrix 50 therein. As the slurry flow passes through the magnetized gaps 56 of the matrix 50, magnetic particles in the slurry immediately adhere to ridges of the grooved plates 55 while non-magnetic particles continue to pass through the gaps 56, and exit trough the funnel 23 to pass to the distributor 25. The non-magnetic particles are then delivered to the channel 69 of the three-way chute 27 as a non-magnetic product.

After a predetermined time and/or upon delivery of a predetermined quantity of slurry, the PLC 70 executes a second stage in the slurry feed cycle via magnetic sieve 21*a*. Prior to performing the second stage operation, the PLC 70 controls actuator 62 to adjust the moveable outlet 60 of distributor 24 to align with channel 66 of three-way chute 26; and turns on power supply 71 to energize electromagnetic coils 54 to generate a magnetic field in the magnetic matrix 50, and the gaps 56 thereof, in magnetic sieve 21*a*. The PLC 70 then controls actuator 46 to laterally move ejectors 28-30 to reposition feed inlet 28 above magnetic sieve 21*a* and reposition flush inlet 30 above magnetic sieve 21*b*. In this position, flush inlet 29 is positioned over a gutter 73 located adjacent an outer-side of the magnetic sieve 21*a* (see FIGS. 4-6). Preferably, this lateral shift of the ejectors 28-30 is made while the slurry feed flow is continuously fed to the feed inlet 28, without any interruption, thereby maintaining a continuous throughput of the magnetic separator. Following the lateral shift of the ejectors 28-30, the slurry flow passing through slurry line 31, to flexible hose 47, and out from feed inlet 28, then flows into sieve 21*a* for magnetic separation by the magnetized matrix 50 therein. As the slurry flow passes through the magnetized gaps 56 of the magnetic matrix 50, magnetic particles in the slurry immediately adhere to ridges of the grooved plates 55 while the non-magnetic particles continue to pass through the gaps 56 and exit trough the funnel 22 to pass to the distributor 24. The non-magnetic particles are then delivered to the channel 66 of the three-way chute 26 as a non-magnetic product.

After a predetermined time and/or upon delivery of a predetermined quantity of slurry, the PLC 70 executes a subsequent slurry feed cycle, that again begins with a first stage executed at magnetic sieve 21*b*. Prior to performing the subsequent slurry feed cycle, the PLC 70 controls actuator 63 to adjust the moveable outlet 61 of distributor 25 to again align with channel 69 of three-way chute 27; and again turns on power supply 72 to energize electromagnetic coils 54 to generate a magnetic field in the magnetic matrix 50, and the gaps 56 thereof, in magnetic sieve 21*a*. The PLC 70 then controls actuator 46 to laterally move ejectors 28-30 to again reposition feed inlet 28 above magnetic sieve 21*b* and reposition flush inlet 29 above magnetic sieve 21*a*. In this position, flush inlet 30 is again positioned over gutter 74. It is again preferable that this lateral shift of the ejectors 28-30 is made while the slurry feed flow is continuously fed to the feed inlet 28, without any interruption, thereby maintaining a continuous throughput of the magnetic separator. Following this lateral shift of the ejectors 28-30, the subsequent slurry feed cycle is then repeated in the same manner as the previous slurry feed cycle.

The PLC 70 may control the magnetic separator 18 to iteratively perform slurry feed cycles, repeating the first and second stage operations in each cycle, throughout a prolonged production run in which any number of successive slurry feed cycles may be executed. While the PLC 70 may intermittently start and stop the flow of a slurry feed through the magnetic separator 18 between separate stages, it is preferable that the PLC 70 instead operate to continuously feed a slurry flow through the magnetic separator 18, without interruption, by continuing to supply slurry flow through the feed inlet 28 even while the ejectors 29-30 are being laterally shifted between the first and second stage operations.

In magnetic separators that include a discharge gate 140, before each respective stage in a slurry feed cycle, PLC 70 also commands the two-position actuator 142 to close flaps 143/145 to preclude passage of the slurry feed flow through the gateway and to the corresponding distributor 24/25. While the flaps 143/145 are in the closed position, a slurry feed flow is fed into the sieve 21*a*/21*b* for the respective stage of the slurry feed cycle, for magnetic separation through the corresponding magnetic matrix 50 in the manner described previously. However, in this configuration, the sieved slurry feed flow that passes through the magnetic matrix 50 is retained inside the matrix frame 51 (and potentially within the matrix 50 depending on respective volumes) for a residence period until a release condition is fulfilled—e.g., passage of a preset time, or occurrence of a predetermined event (such as sensing of a threshold volume or weight at the gateway). Upon satisfaction of the release condition, PLC 70 commands the two-position actuator 142 to open flaps 143/145 to permit passage of the sieved slurry feed flow for delivery to the distributor 24/25 and discharge to a designated channel of the corresponding three-way chute 26/27. This operation is the same for each of the magnetic separators herein, including magnetic separator 18 as well as all other separator systems further disclosed herein.

In parallel with the slurry feed cycles, as executed via the feed inlet 28, the PLC 70 at the same time effects flushing cycles, via flush inlets 29/30, with each flushing cycle including first and second stage operations in which a flushing fluid is directed to two separate magnetic sieves 21*a*/21*b*. In a flushing cycle, each of the first and second stage operations is performed in two modes: a middling product flushing mode, and a magnetic product flushing mode. These two flushing modes, defining a single flushing stage, must be finished in the same operation period in which a single slurry feed stage is completed.

In a first stage of a flushing cycle, when the feed inlet 28 is positioned to perform a first stage of a slurry feed cycle at magnetic sieve 21*b*, flush inlet 29 is positioned over magnetic sieve 21*a* and flush inlet 30 is positioned over gutter 74. In such an instance, the magnetic sieve 21*a* will have previously received a slurry flow during a second stage operation in a prior slurry feed cycle, and is thus loaded with magnetic particles adhered to ridges of the grooved plates 55 by a magnetic field. With the flush inlets 29/30 positioned such, the first stage operation of this flushing cycle includes performance of a first and second mode flushing to the magnetic sieve 21*a*.

In the first mode of the first stage operation of a flushing cycle, a middling product flushing mode is executed. In this first mode, PLC 70 continues providing power to the power supply 71, energizing electromagnetic coils 54, to maintain the magnetic field in the magnetic matrix 50, and the gaps 56 thereof, in magnetic sieve 21*a*. The PLC 70 also controls actuator 62 to adjust the moveable outlet 60 of distributor 24 to align with channel 65 of three-way chute 26. Thereafter, the PLC 70 turns the switching valve 33 to an open state, thereby enabling passage of a flushing fluid flow from the flushing manifold 32, out through flush inlet 29, for delivery to the magnetic sieve 21*a*. A pressure of the flushing fluid flow during this middling mode operation is controlled by the regulating valve 34, which may be set in advance or controlled in tandem with control of the switching valve 33. Delivery of the flushing fluid flow in this first mode removes non-magnetic particles that have become trapped within the magnetic matrix 50 due to blockage by the magnetic particles that have adhered to the surfaces of the grooved plates 55. The non-magnetic particles removed in this first mode are defined as middling product. Upon being dislodged from the magnetic matrix 50, the middling products are carried with the flushing fluid flow down through the gaps 56 of the magnetic matrix 50, out the funnel 22, and into the distributor 24. The flushing fluid flow, with the middling product therein, is then discharged to channel 65 of the of three-way chute 26 as middling product. After a predetermined time and/or upon delivery of a predetermined quantity of flushing fluid and/or reception of a predetermined quantity of middling product at channel 65, the PLC 70 closes switching valve 33, thereby ceasing delivery of the flushing fluid flow in the middling product flushing mode.

In a second mode of the first stage operation of the flushing cycle, a magnetic product flushing mode is executed. In this second mode, PLC 70 controls actuator 62 to adjust the moveable outlet 60 of distributor 24 to align with channel 64 of three-way chute 26. The PLC 70 also reduce power to the power supply 71, decreasing an energized state of the electromagnetic coils 54, and effectively reducing the strength of the magnetic field in the magnetic matrix 50, and the gaps 56 thereof, in magnetic sieve 21*a*. In some instances the PLC 70 may entirely discontinue power to the power supply 71. The PLC 70 then turns the switching valve 35 to an open state, thereby enabling passage of a flushing fluid flow from the flushing manifold 32, out through flush inlet 29, for delivery to the magnetic sieve 21*a*. A pressure of the flushing fluid flow during this magnetic product flushing mode operation is controlled by the regulating valve 36, which may be set in advance or controlled in tandem with control of the switching valve 35. Delivery of the flushing fluid flow in this second mode removes magnetic particles that were adhered to the surface of the grooved plates 55 by a magnetic field—the reduction to the power supply 71 having reduced the strength of the magnetic field sufficiently to permit dislodging of these magnetic particles by the flushing fluid flow. The magnetic particles removed in this second mode are defined as magnetic product. Upon being dislodged from the magnetic matrix 50, the magnetic product is carried with the flushing fluid flow down through the gaps 56 of the magnetic matrix 50, out the funnel 22, and into the distributor 24. The flushing fluid flow, with the magnetic product therein, is then discharged to channel 64 of the of three-way chute 26 as magnetic product. After a predetermined time and/or upon delivery of a predetermined quantity of flushing fluid and/or reception of a predetermined quantity of magnetic product at channel 64, the PLC 70 closes switching valve 35, thereby ceasing delivery of the flushing fluid flow in the magnetic product flushing mode.

After completing a first stage of a flushing cycle at the magnetic sieve 21*a*, a second stage of the flushing cycle is then performed at the magnetic sieve 21*b*. Prior to beginning the second stage operation, the PLC 70 controls actuator 46 to laterally move ejectors 28-30 to reposition feed inlet 28 above magnetic sieve 21*a* and reposition flush inlet 30 above magnetic sieve 21*b*. In this position, flush inlet 29 is positioned over the gutter 73. In such an instance, the magnetic sieve 21*b* will have previously received a slurry flow during a first stage operation in a prior slurry feed cycle, and is thus loaded with magnetic particles adhered to ridges of the grooved plates 55 by a magnetic field. With the flush inlets 29/30 positioned such, the second stage operation of this flushing cycle includes performance of a first and second mode flushing to the magnetic sieve 21*b*, in similar fashion as performed to magnetic sieve 21*a* in the first mode operation.

In a first mode of the second stage operation of the flushing cycle, a middling product flushing mode is again executed. The PLC 70 continues providing power to the power supply 72, energizing electromagnetic coils 54, to maintain the magnetic field in the magnetic matrix 50, and the gaps 56 thereof, in magnetic sieve 21*b*. The PLC 70 also controls actuator 63 to adjust the moveable outlet 61 of distributor 25 to align with channel 68 of three-way chute 27. Thereafter, the PLC 70 turns the switching valve 39 to an open state, thereby enabling passage of a flushing fluid flow from the flushing manifold 32, out through flush inlet 30, for delivery to the magnetic sieve 21*b*. A pressure of the flushing fluid flow during this middling mode operation is controlled by the regulating valve 40, which may be set in advance or controlled in tandem with control of the switching valve 39. Delivery of the flushing fluid flow in this first mode removes non-magnetic particles that have become trapped within the magnetic matrix 50 due to blockage by the magnetic particles that have adhered to the surfaces of the grooved plates 55. The non-magnetic particles removed in this first mode are defined as middling product. Upon being dislodged from the magnetic matrix 50, the middling products are carried with the flushing fluid flow down through the gaps 56 of the magnetic matrix 50, out the funnel 23, and into the distributor 25. The flushing fluid flow, with the middling product therein, is then discharged to channel 68 of the of three-way chute 27 as middling product. After a predetermined time and/or upon delivery of a predetermined quantity of flushing fluid and/or reception of a predetermined quantity of middling product at channel 68, the PLC 70 closes switching valve 39, thereby ceasing delivery of the flushing fluid flow in the middling product flushing mode.

In a second mode of the second stage operation of the flushing cycle, a magnetic product flushing mode is executed. The PLC 70 controls actuator 63 to adjust the moveable outlet 61 of distributor 25 to align with channel 67 of three-way chute 27. The PLC 70 also reduce power to the power supply 72, decreasing an energized state of the electromagnetic coils 54, and effectively reducing the strength of the magnetic field in the magnetic matrix 50, and the gaps 56 thereof, in magnetic sieve 21*b*. In some instances the PLC 70 may entirely discontinue power to the power supply 72. Thereafter, the PLC 70 turns the switching valve 41 to an open state, thereby enabling passage of a flushing fluid flow from the flushing manifold 32, out through flush inlet 29, for delivery to the magnetic sieve 21*b*. A pressure of the flushing fluid flow during this magnetic product flushing mode operation is controlled by the regulating valve 42, which may be set in advance or controlled in tandem with control of the switching valve 41. Delivery of the flushing fluid flow in this second mode removes magnetic particles that were adhered to the surface of the grooved plates 55 by a magnetic field—the reduction to the power supply 72 having reduced the strength of the magnetic field sufficiently to permit dislodging of these magnetic particles by the flushing fluid flow. The magnetic particles removed in this second mode are defined as magnetic product. Upon being dislodged from the magnetic matrix 50, the magnetic product is carried with the flushing fluid flow down through the gaps 56 of the magnetic matrix 50, out the funnel 23, and into the distributor 25. The flushing fluid flow, with the magnetic product therein, is then discharged to channel 67 of the of three-way chute 27 as magnetic product. After a predetermined time and/or upon delivery of a predetermined quantity of flushing fluid and/or reception of a predetermined quantity of magnetic product at channel 67, the PLC 70 closes switching valve 41, thereby ceasing delivery of the flushing fluid flow in the magnetic product flushing mode.

The PLC 70 executes a subsequent flushing cycle, that again begins with a first stage executed at magnetic sieve 21*a*. Prior to performing the subsequent flushing cycle, the PLC 70 controls actuator 46 to laterally move ejectors 28-30 to again reposition feed inlet 28 above magnetic sieve 21*b* and reposition flush inlet 29 above magnetic sieve 21*a*. In this position, flush inlet 30 is again positioned over gutter 74. Following this lateral shift of the ejectors 28-30, the subsequent flushing cycle is then repeated in the same manner as the previous flushing cycle.

The PLC 70 may control the magnetic separator 18 to iteratively perform flushing cycles, repeating the first and second stage operations in each cycle, with each stage having both first and second modes, throughout a prolonged production run in which any number of successive flushing cycles may be executed.

As discussed previously, when switching a material feed flow from one magnetic sieve (e.g., 21*b*) to another magnetic sieve (e.g., 21*a*), the PLC 70 reduces or eliminates an electrical power to the power supply 71/72 in the one magnetic sieve (21*b*) in order to permit purging of magnetic components therefrom under force of a flushing fluid flow. In addition to reducing or eliminating a power supply, the PLC 70 may at the same time reverse a polarity of the corresponding power supply 71/72. Such a polarity reversal has the effect of summing up the power supply voltage to counter electromotive forces in the electromagnetic coil 54, thereby giving rise to a stronger current reversal to promote a faster decay of the magnetic field previously generated in the corresponding magnetic matrix 50. In examples employing such polarity reversals, the power supplies 71/72 may use power contactors or semiconductor rectifiers that are configured for four-quadrant operation, with the PLC 70 programmed to switch the power supplies 71/72 to reverse polarity as needed. When reestablishing a magnetic field in a previously depowered magnetic matrix 50, the PLC 70 may switch the power supplies 71/72 to a direct polarity so as to supply power to the electromagnetic coil 54 in a shorter time with a steeper current surge. The PLC 70 may be adjusted to allow for some overshoot in the transition to more quickly establish a sufficient magnetic field. In such examples, the magnetic separator is capable of generating target magnetic field strengths more quickly, with the PLC 70 programmed to assure precise behavior and short transition times between the separate operating states, substantially increasing a throughput and output of the system. Larger coils may be split into smaller coils units, to reduce the individual inductance, providing a faster switching time.

Figure 14:
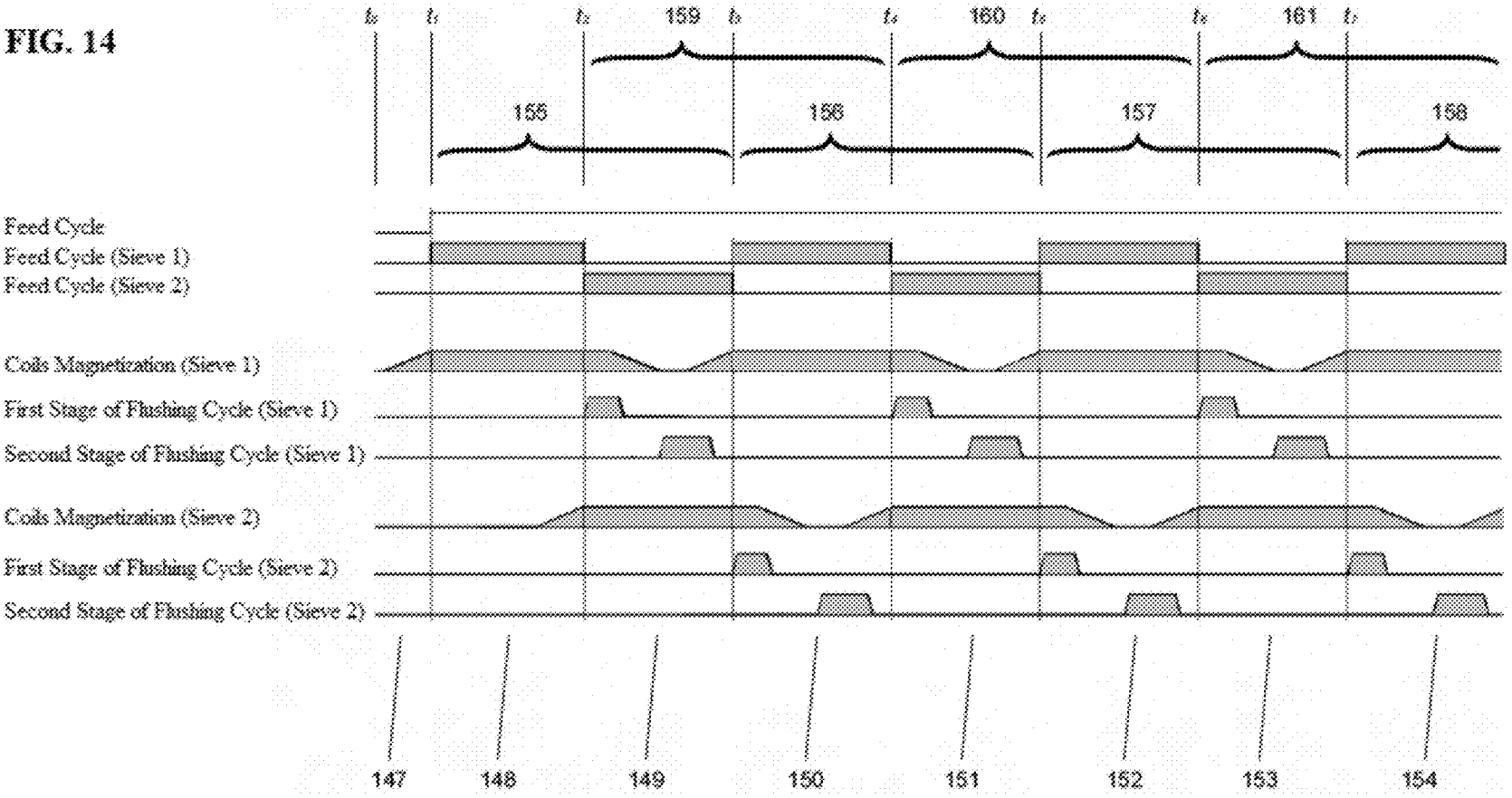
FIG. 14 shows a flow control for a production run executed with the magnetic separator of FIG. 4.
Figure 15:
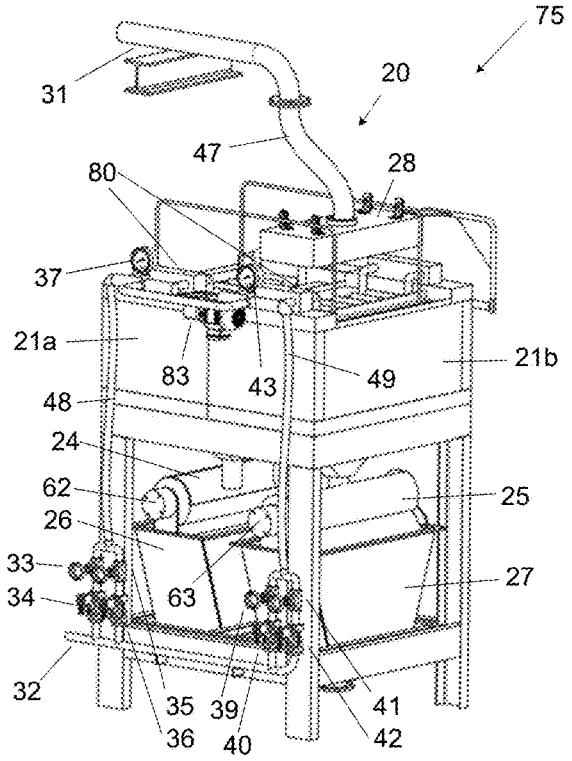
FIG. 15 shows another example of a magnetic separator according to the present invention.
Figure 16:
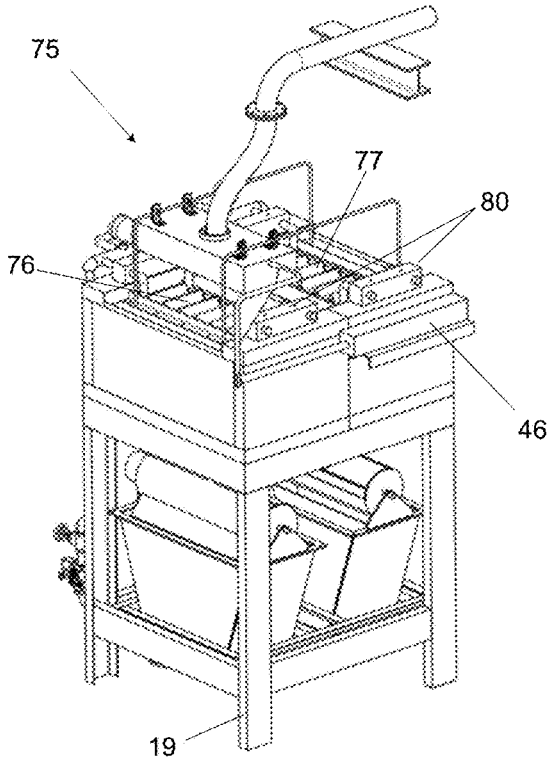
FIG. 16 shows an alternate perspective view of the magnetic separator of FIG. 15.
Figure 17:
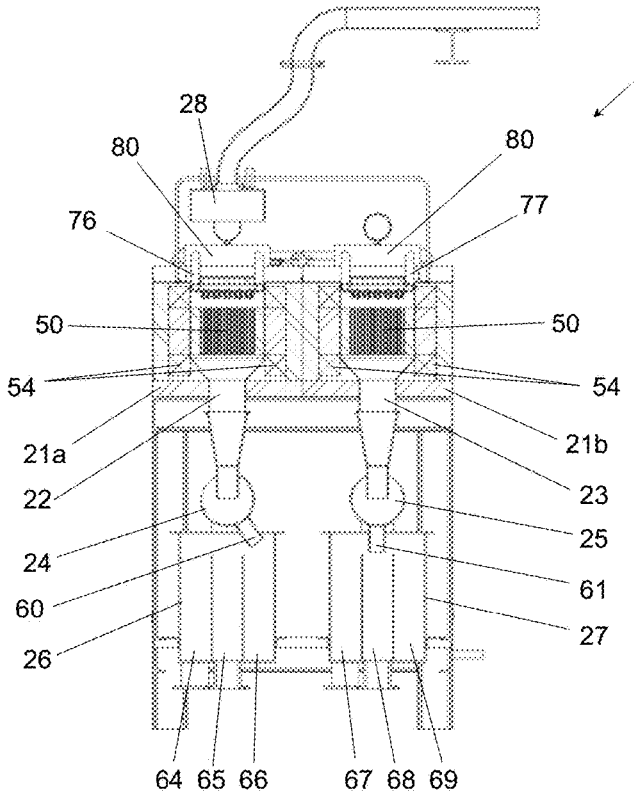
FIG. 17 shows a front elevation cross-section view of the magnetic separator of FIG. 15.
Figure 18:
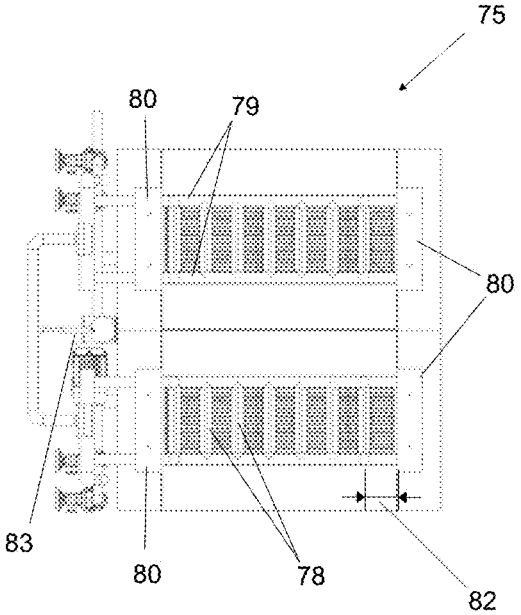
FIG. 18 shows a top plan view of the platform of the magnetic separator of FIG. 15.

FIG. 14 shows one example of a material flow control executed by the PLC 70 in the magnetic separator 18, as well as all other separator systems further disclosed herein, in a single production run for the magnetic separation of components in a slurry feed flow. In the illustrated example, the magnetic separator is initially in a non-operating state at a time to. In a subsequent operation period 147, power is supplied to the magnetic coils in a first magnetic sieve (e.g., magnetic sieve 21*b*), thereby generating a magnetic field within the matrix thereof; and a slurry feed flow is provided to the first magnetic sieve.

In an operation period 148, beginning at a time $t_1$, the matrix in the first magnetic sieve is fully magnetized and the slurry feed flow is introduced to the first magnetic sieve at a target flow rate for the production run. During this operation period 148, a first stage in a first slurry feed cycle 155 is executed at the first magnetic sieve. As the first stage in the first slurry feed cycle 155 nears an end, an electrical power is supplied to the magnetic coils in a second magnetic sieve (e.g., magnetic sieve 21*a*), thereby generating a magnetic field within the matrix thereof.

In an operation period 149, beginning at a time $t_2$, the slurry feed flow is switched from the first magnetic sieve to the second magnetic sieve; and a flushing fluid flow is provided to the first magnetic sieve. During this operation period 149, a second stage in the first slurry feed cycle 155 is executed at the second magnetic sieve, and a first stage in a first flushing cycle 159 is executed at the first magnetic sieve. The first stage of the first flushing cycle 159 begins at the time $t_2$ with a first mode of operation for removing non-magnetic particles from the first magnetic sieve while the electric coils thereof continue to generate a magnetic field (e.g., a middling product flushing mode). As the first mode of operation nears an end, power to the magnetic coils in the first magnetic sieve is reduced (or eliminated entirely), and a second mode of operation is then executed for removing magnetic particles from the first magnetic sieve (e.g., a magnetic product flushing mode). As the second mode of operation nears an end, power is again supplied to the magnetic coils in the first magnetic sieve to again generate a magnetic field within the matrix thereof.

In an operation period 150, beginning at a time $t_3$, a flushing fluid flow to the first magnetic sieve is cease; the slurry feed flow is switched from the second magnetic sieve to the first magnetic sieve; and a flushing fluid flow is provided to the second magnetic sieve. During this operation period 150, a first stage in a second slurry feed cycle 156 is executed at the first magnetic sieve, and a second stage in the first flushing cycle 159 is executed at the second magnetic sieve. The first stage in the second slurry feed cycle 156 is executed in the same manner that the first stage in the first slurry feed cycle 155 was executed. The second stage of the first flushing cycle 159 begins at the time $t_3$ with a first mode of operation for removing non-magnetic particles from the second magnetic sieve while the electric coils thereof continue to generate a magnetic field (e.g., a middling product flushing mode). As the first mode of operation nears an end, power to the magnetic coils in the second magnetic sieve is reduced (or eliminated entirely), and a second mode of operation is then executed for removing magnetic particles from the second magnetic sieve (e.g., a magnetic product flushing mode). As the second mode of operation nears an end, power is again supplied to the magnetic coils in the second magnetic sieve to again generate a magnetic field within the matrix thereof.

During an operation period 151, beginning at a time $t_4$, a second stage in the second slurry feed cycle 156 is executed at the second magnetic sieve, with this second stage being executed in the same manner as in previous slurry feed cycles; while a first stage in a second flushing cycle 160 (including first and second modes) is executed at the first magnetic sieve, with this first stage being executed in the same manner as in previous flushing cycles. During an operation period 152, beginning at a time $t_5$, a first stage in a third slurry feed cycle 157 is executed at the first magnetic sieve, with this first stage being executed in the same manner as in previous slurry feed cycles; while a second stage in the second flushing cycle 160 (including first and second modes) is executed at the second magnetic sieve, with this second stage being executed in the same manner as in previous flushing cycles. During an operation period 153, beginning at a time $t_6$, a second stage in the third slurry feed cycle 157 is executed at the second magnetic sieve, with this second stage being executed in the same manner as in previous slurry feed cycles; while a first stage in a third flushing cycle 161 (including first and second modes) is executed at the first magnetic sieve, with this first stage being executed in the same manner as in previous flushing cycles. During an operation period 154, beginning at a time $t_7$, a first stage in a fourth slurry feed cycle 158 is executed at the first magnetic sieve, with this first stage being executed in the same manner as in previous slurry feed cycles; while a second stage in the third flushing cycle 161 (including first and second modes) is executed at the second magnetic sieve, with this second stage being executed in the same manner as in previous flushing cycles.

The production run continues cyclically in accord with the foregoing discussion until completion. While the slurry feed flow may be intermittently stopped and started when switching between separate magnetic sieves (e.g., as at times $t_2$-$t_7$, etc.), it is preferable that the slurry feed flow instead be maintained at the target flow rate to continuously feed a slurry flow through the magnetic separator, without any interruption. In this way, magnetic separators according to the present invention are capable of achieving a 100% throughput of slurry feed flow without any downtime in output. This is made possible by the present invention as a continuous slurry feed flow may be redirected from one magnetic sieve to another, with one magnetic sieve remaining operational to separate magnetic and non-magnetic particles from the slurry feed flow while the other magnetic sieve is cleansed in a flushing operation, thereby permitting cleansing of the separate magnetic sieves without ceasing or decreasing the flow rate of the slurry feed flow.

FIGS. 15-18 show a second example of a magnetic separator 75 according to the present invention. Magnetic separator 75 shares many of the same structural features of magnetic separator 18, and those common features are incorporated into this discussion without further explanation. However, in the magnetic separator 75 the diffusor 20 supported above platform 19 includes only a single ejector 28, in the form of the feed inlet 28. The feed inlet 28 alone is laterally shifted by the actuator 46 to be positioned, iteratively, over the two magnetic sieves 21*a*/21*b*.

In place of the flush inlets 29/30 provided in magnetic separator 18, magnetic separator 75 instead includes flush inlets 76/77 that are mounted within the trough 57 of the magnetic frame 51 of the respective magnetic sieves 21*a*/21*b*. As with the flush inlets 29/30 of magnetic separator 18, flush inlets 76/77 are likewise in fluid communication with a flushing manifold 32, with dedicated switching valves 33/35/39/41 and regulating valves 34/36/40/42, though in this example flushing fluid manifold 32 is supported on the platform 19, below the magnetic sieves 21*a*/21*b*. In the illustrated example of magnetic separator 75, a single pressure meter 37 is provided on flexible hose 48, and a single pressure meter 43 is provided on flexible hose 49—however, magnetic separator 75 may instead include dedicated pressure meters 37/38/43/44, positioned in the same manner as in magnetic separator 18.

Flush inlets 76/77 both include a series of lateral beams 78 spanning between a pair of support arms 79 that are suspended between a pair of support bases 80, with dispensing nozzles 81 positioned at an underside of each lateral beam 78. Optionally, the support arms 79 may be movable along the platform 19, for reciprocal displacement along a length of the magnetic matrices 50, in a direction transverse to a moving direction of feed inlet 28, by a reciprocating displacement distance 82, under a driving force from an actuator 83. This may be achieved by having the support arms 79 supported movably within through-holes in the support bases 80, thereby permitting the support arms 79 to move reciprocally in fore-rear directions of the platform 19. In this way, the dispensing nozzles 81 at the undersides of the lateral beams 78 may be reciprocally displaced over the distance 82 for further dispersing a flushing fluid flow. Preferably, a top side of each lateral beam 78 is formed with an upward oriented spire in a wedge shape for guiding a slurry flow output from the feed inlet 28 thereabove to spaces between the lateral beams 78.

Figure 19:
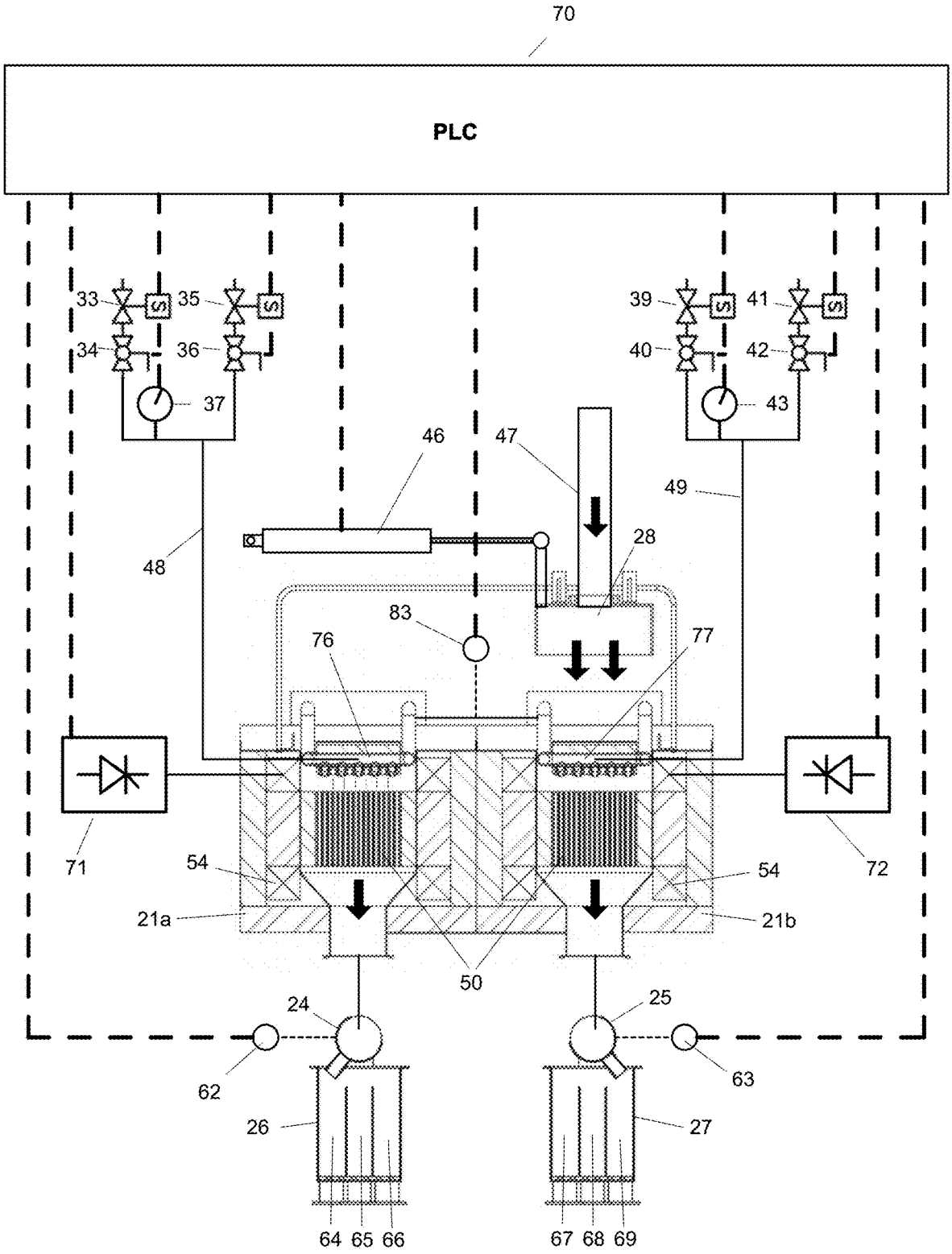
FIG. 19 shows a control scheme for the magnetic separator of FIG. 15.

FIG. 19 shows one example of a control scheme for a magnetic separator 75. As seen in the illustrated example, operation of the magnetic separator 75, may again be controlled by the PLC 70, which is in signal communication with the two-position actuator 46, the reciprocating actuator 83, the three-position actuators 62/63, the switching valves 33/35/39/41, and power supplies 71/72 for the electromagnetic coils 54. In the example shown in FIG. 19, regulating valves 34/36/40/42 and pressure valves 37/43 are also controlled by PLC 70; however, in some examples the regulating valves and/or pressure valves may each be manually controlled or adapted for both manual and PLC control. If including a discharge gate 140, the PLC 70 is also in signal communication with the two-positon actuator 142 for controlling positioning of the flaps 143/145.

Operation of the magnetic separator 75 is similar to that of the magnetic separator 18, in that the feed inlet 28 in magnetic separator 75 is operated in the same cyclic manner as in magnetic separator 18, with a single slurry cycle including a first stage at one magnetic sieve 21*b* and a second stage at another magnetic sieve 21*a*. In executing slurry cycles via the feed inlet 28, the PLC 70 effects the same controls in magnetic separator 75 as is done in magnetic separator 18, as discussed previously. Differences arise in the operation of the magnetic separator 75, in that flush inlets 76/77 are not displaced cyclically together with the feed inlet 28, and are instead installed within the respective magnetic sieves 21*a*/21*b*. In this arrangement, the flush inlets 76/77 may instead be held stationary within the corresponding magnetic sieves 21*a*/21*b*, or may be reciprocally displaced along a length of the magnetic matrices 50, in the fore-rear directions of the platform 19, by a displacement distance 82 via the actuator 83. Apart from the flush inlets 76/77 remaining at the respective magnetic sieve 21*a*/21*b*, rather than being displaced in tandem with the inlet feed 28, the PLC 70 executes flushing cycles, in first and second stages, with first and second modes of operation in both stages, in magnetic separator 75 in the same manner and with the same timing as is done in magnetic separator 18, as shown as discussed previously.

Optionally, the flush inlets 76/77 may be continuously reciprocated along a length of the respective magnetic matrices 50, even while the feed inlet 28 is feeding slurry to a respective magnetic sieve 21*a*/21*b*, as such movement may improve distribution of a slurry flow along the magnetic matrices 50.

Figure 20:
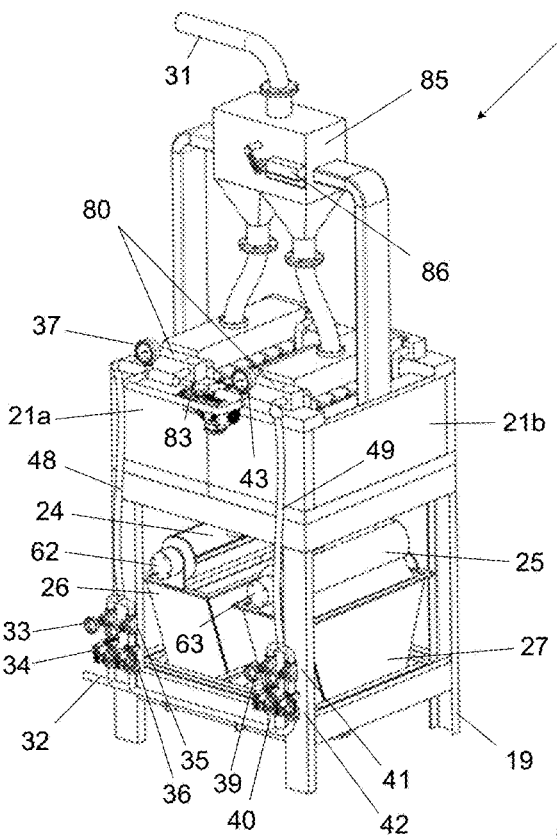
FIG. 20 shows another example of a magnetic separator according to the present invention.
Figure 21:
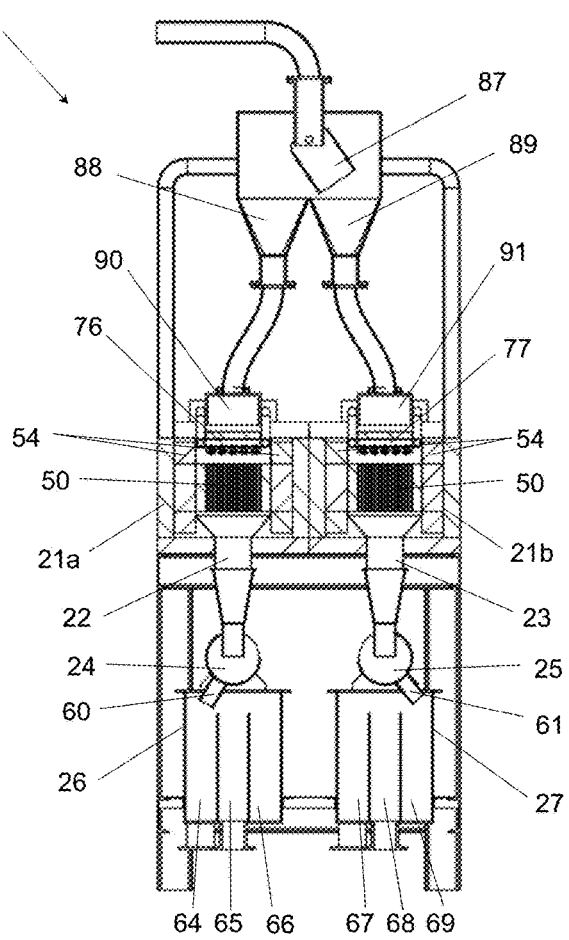
FIG. 21 shows a front elevation cross-section view of the magnetic separator of FIG. 20.
Figure 22:
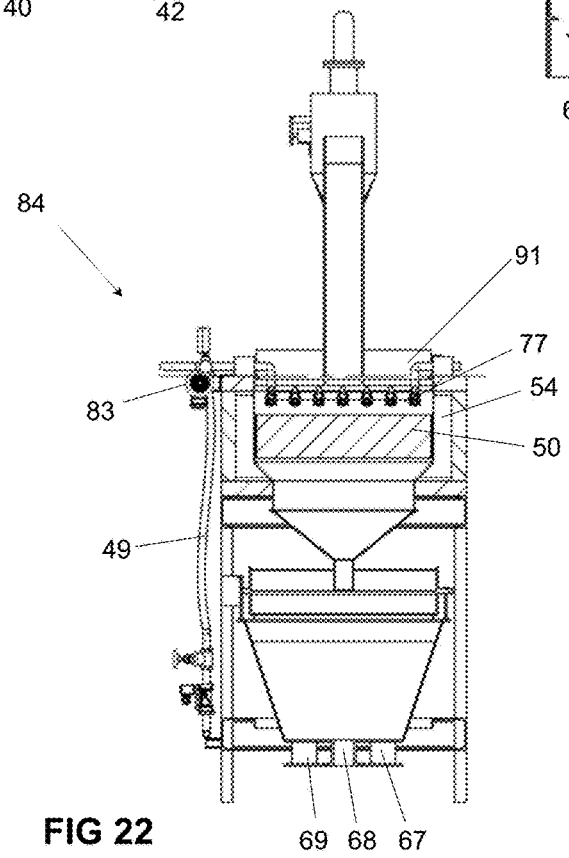
FIG. 22 shows a side elevation cross-section view of the magnetic separator of FIG. 20.

FIGS. 20-22 show a third example of a magnetic separator 84 according to the present invention. Magnetic separator 84 shares many of the same structural features of magnetic separators 18 and 75, and those common features are incorporated into this discussion without further explanation. However, in the magnetic separator 84 the diffusor 20 is replaced with a silo 85 that is supported above platform 19. The silo 85 includes an actuator 86 for moving a chute 87 between a first position for directing a slurry feed flow to a first funnel 88 and a second funnel 89, with the two funnels 88/89 being in fluid communication with respective ejectors 90/91 in the form of feed inlets 90/91. Magnetic separator 84 also adopts the flush inlets 76/77 of magnetic separator 75, rather than the flush inlets 29/30 of magnetic separator 18. With the arrangement in magnetic separator 84, there is no lateral movement of any ejectors between the separate magnetic sieves 21*a*/21*b*.

In magnetic separator 84, the feed inlets 90/91 are held stationary, and fixedly mounted on the respective magnetic sieves 21*a*/21*b*. In operation, a slurry feed flow is introduced from slurry line 31 to silo 85, and then fed alternately through one of the two funnels 88/89 via control of the chute 87 via actuator 86. In a slurry cycle, the PLC 70 may control the magnetic separator to perform a first stage operation by commanding actuator 86 to position chute 87 for directing a slurry feed flow to funnel 89 and out feed inlet 91 for delivery to magnetic sieve 21*b*. At that same time, while slurry feed flow is directed to slurry inlet 91, PLC 70 may execute a flushing cycle at magnetic sieve 21*a* via flush inlet 76. Thereafter, in a second stage operation of the slurry cycle, the PLC 70 may command actuator 86 to reposition chute 87 for directing a slurry feed flow to funnel 88 and out feed inlet 90 for delivery to magnetic sieve 21*a*. At that same time, while the slurry feed flow is directed to feed inlet 90, a flushing cycle may be executed at magnetic sieve 21*b* via flush inlet 77.

Figure 23:
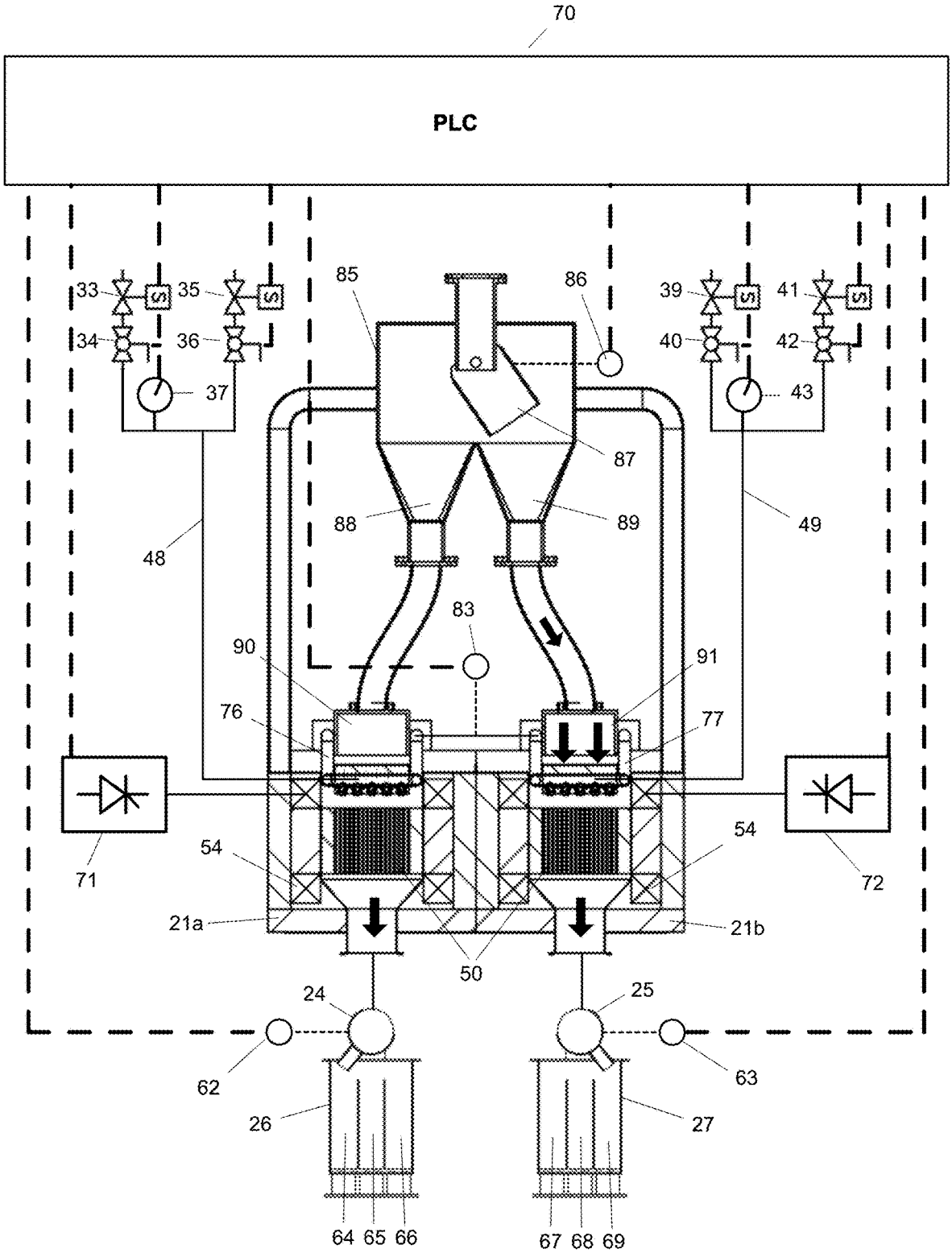
FIG. 23 shows a control scheme for the magnetic separator of FIG. 20.
Figure 24:
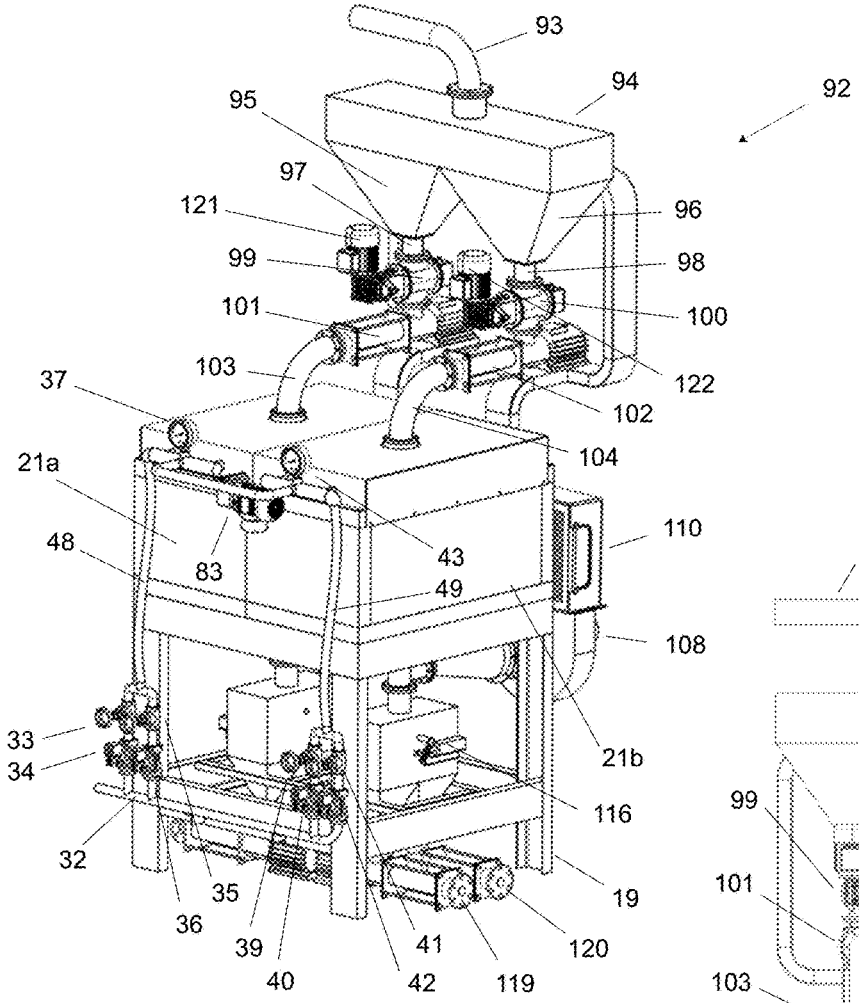
FIG. 24 shows another example of a magnetic separator according to the present invention.
Figure 25:
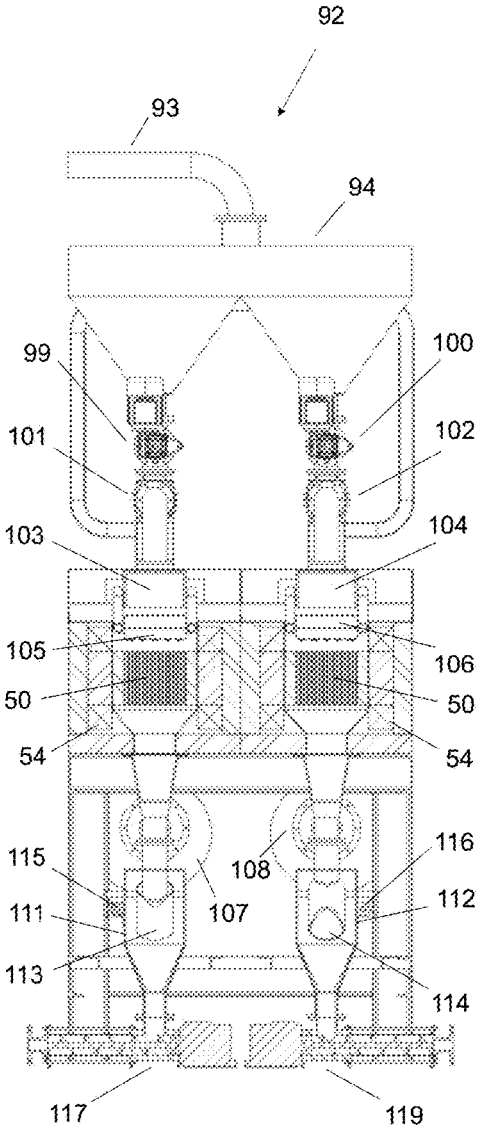
FIG. 25 shows a front elevation cross-section view of the magnetic separator of FIG. 24.
Figure 26:
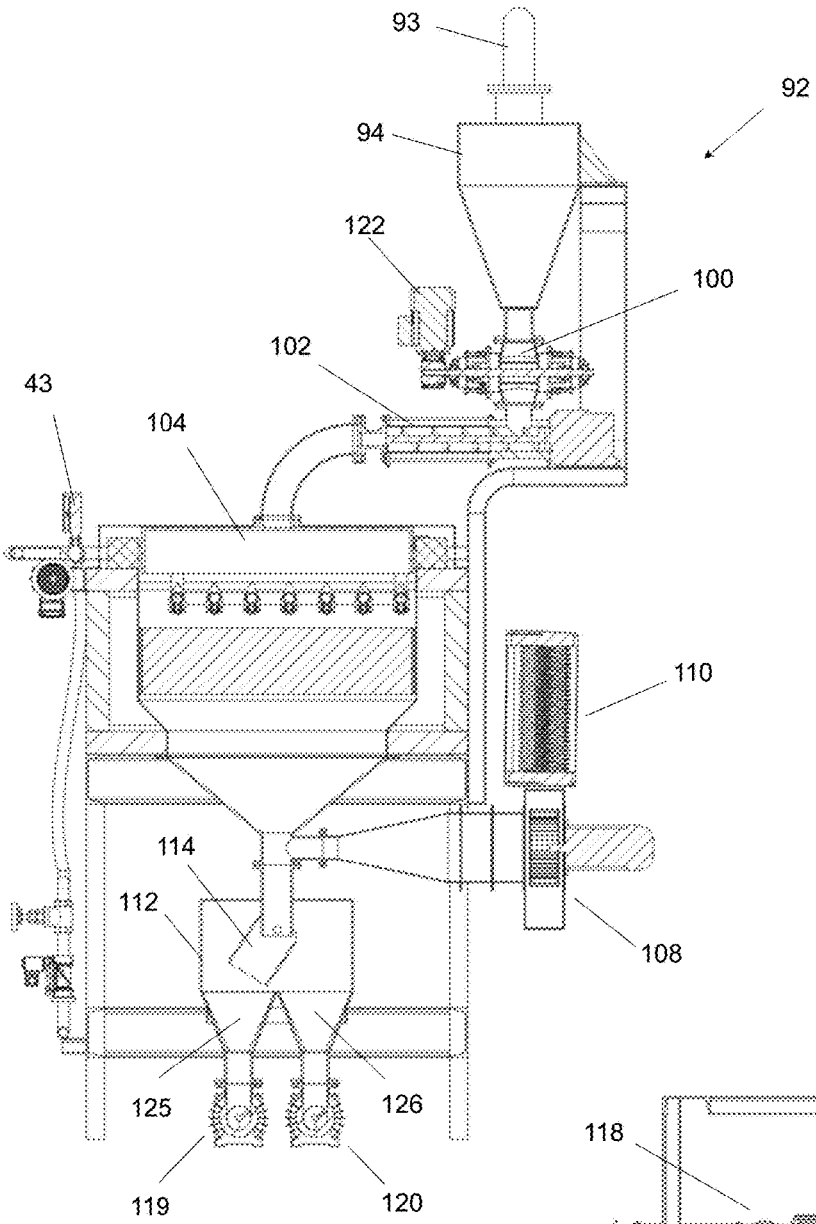
FIG. 26 shows a side elevation cross-section view of the magnetic separator of FIG. 24.
Figure 27:
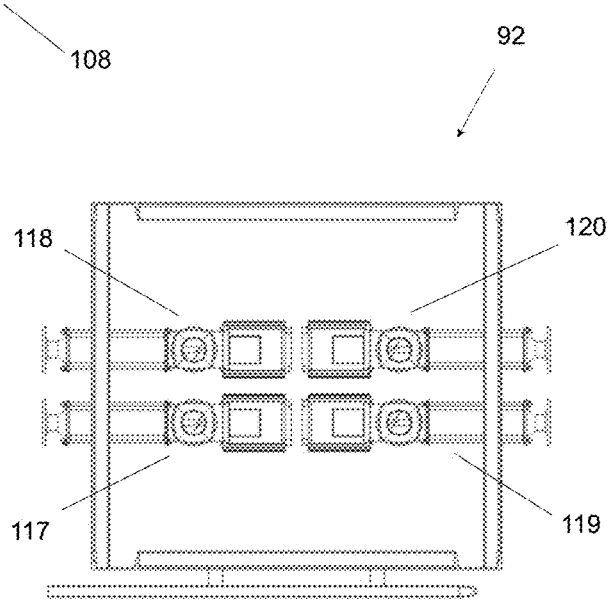
FIG. 27 shows a bottom plan view of the magnetic separator of FIG. 24.

FIG. 23 shows one example of a control scheme for a magnetic separator 84. As seen in the illustrated example, operation of the magnetic separator 84, may again be controlled by the PLC 70, which is in signal communication with the reciprocating actuator 83, the three-position actuators 62/63, the switching valves 33/35/39/41, and power supplies 71/72 for the electromagnetic coils 54. In the example shown in FIG. 23, regulating valves 34/36/40/42 and pressure valves 37/43 are also controlled by PLC 70; however, in some examples the regulating valves and/or pressure valves may each be manually controlled or adapted for both manual and PLC control. If including a discharge gate 140, the PLC 70 is also in signal communication with the two-positon actuator 142 for controlling positioning of the flaps 143/145.

Apart from controlling the operations effected at the silo 85, and the lack of movement of any ejectors, operation of the magnetic separator 84 in effecting control over the magnetic sieves 21*a*/21*b* and the distributors 24/25 in slurry cycles is executed in the same manner and with the same timing as in magnetic separator 18, with the PLC 70 effecting the same controls in magnetic separator 84 as is done in magnetic separator 18, as shown as discussed previously. Likewise, operation of the magnetic separator 84 in effecting control over the flush inlets 76/77 and the distributors 24/25 in flushing cycles, is executed in the same manner and with the same timing as in magnetic separator 18, with the PLC 70 effecting the same controls in magnetic separator 84 as is done in magnetic separator 18, with the exception that magnetic separator 84 incorporates the structural positioning and displacement of flush inlets 76/77 as discussed relative magnetic separator 75 (rather than those of flush inlets 29/30 as discussed relative magnetic separator 18).

FIGS. 24-27 show a fourth example of a magnetic separator 92 according to the present invention. Magnetic separator 92 is intended for effecting separation of magnetic and non-magnetic particles in dry material flows, without reliance on a liquid medium. Dry separation presents several challenges not present in the separation of particles that are suspended in a liquid medium, including dust control, transport and handling of fine particles, and the attraction and repulsion of particles due to electrostatic forces, to name a few. Preferably, the magnetic separator 92 is constructed with airtight sealing to avoid environment contamination by dust from any dry fine material being separated therein.

The magnetic separator 92 shown in FIGS. 24-27 separates a dry material feed into magnetic and non-magnetic particles. In operation, a dry feed material is transported by a feed supply line 93 to a silo 94, which is formed as a divided or dual-hopper construction (e.g., as if formed from two different hoppers 95/96) for outputting a dry material feed flow to respective outlets 97/98. The separate outlets are controlled by respective rotary valves 99/100 that lead to respective dosing screws 101/102. Dosing screw 101 dispenses to a feed inlet 103 for delivering a dry material feed flow to magnetic sieve 21*a*, and dosing screw 102 dispenses to a feed inlet 104 for delivering a dry material feed flow to magnetic sieve 21*b*.

Magnetic sieves 21*a*/21*b* are the same as those described above relative to magnetic separator 18, with the exception that there are provided air nozzles 105/106 in the troughs 57 of the respective magnetic frames 51. The air nozzles 105/106 eject a low pressure airflow downward into the respective magnetic matrices 50, creating a positive pressure flow that effectively generates a force for pulling a dry material feed flow into the respective troughs 57, so as to promote flow of the dry material feed flow through the gaps 56 of the respective magnetic matrices 50. So as to avoid a back-flow of air current up into the silo 94, the rotary valves 99/100 are adapted to provide an airtight seal at the respective outlets 97/98 when in an off-state.

As with earlier examples, funnels 22/23 are provide at the outlet ends of the magnetic sieves 21*a*/21*b*. In magnetic separator 92, there are provided exhaust fans 107/108 in fluid communication with the respective funnels 22/23. The exhaust fans 107/108 provide continuous air flows into the respective funnels 22/23 to thereby generate negative pressure flows below the respective magnetic matrices 50 that effectively generates a suction for pulling a dry material feed flow through the respective funnels 22/23. Together, the pressure flows provided by air nozzles 105/106 and exhaust fans 107/108 generate complimenting push-and-pull forces that promote a smooth laminar flow of a fine dry material feed flow through the respective magnetic matrices 50. The resulting airflow passes through respective air filters 109/110 for release back into the atmosphere, free of dust particles.

The funnels 22/23 lead to respective distributors 111/112, with moveable chutes 113/114 provided inside the distributors 111/112 at outlet ends of the respective funnels 22/23. The chutes 113/114 are moveable between first positions and second positions, under control of the PLC 70 via respective actuators 115/116. Chute 113 is moveable between a first position and a second position, for feeding to respective first and second funnels 123/124 that lead to respective first and second discharge screws 117/118. Likewise, chute 114 is moveable between a first position and a second position, for feeding to respective first and second funnels 125/126 that lead to respective first and second discharge screws 119/120.

Figure 28:
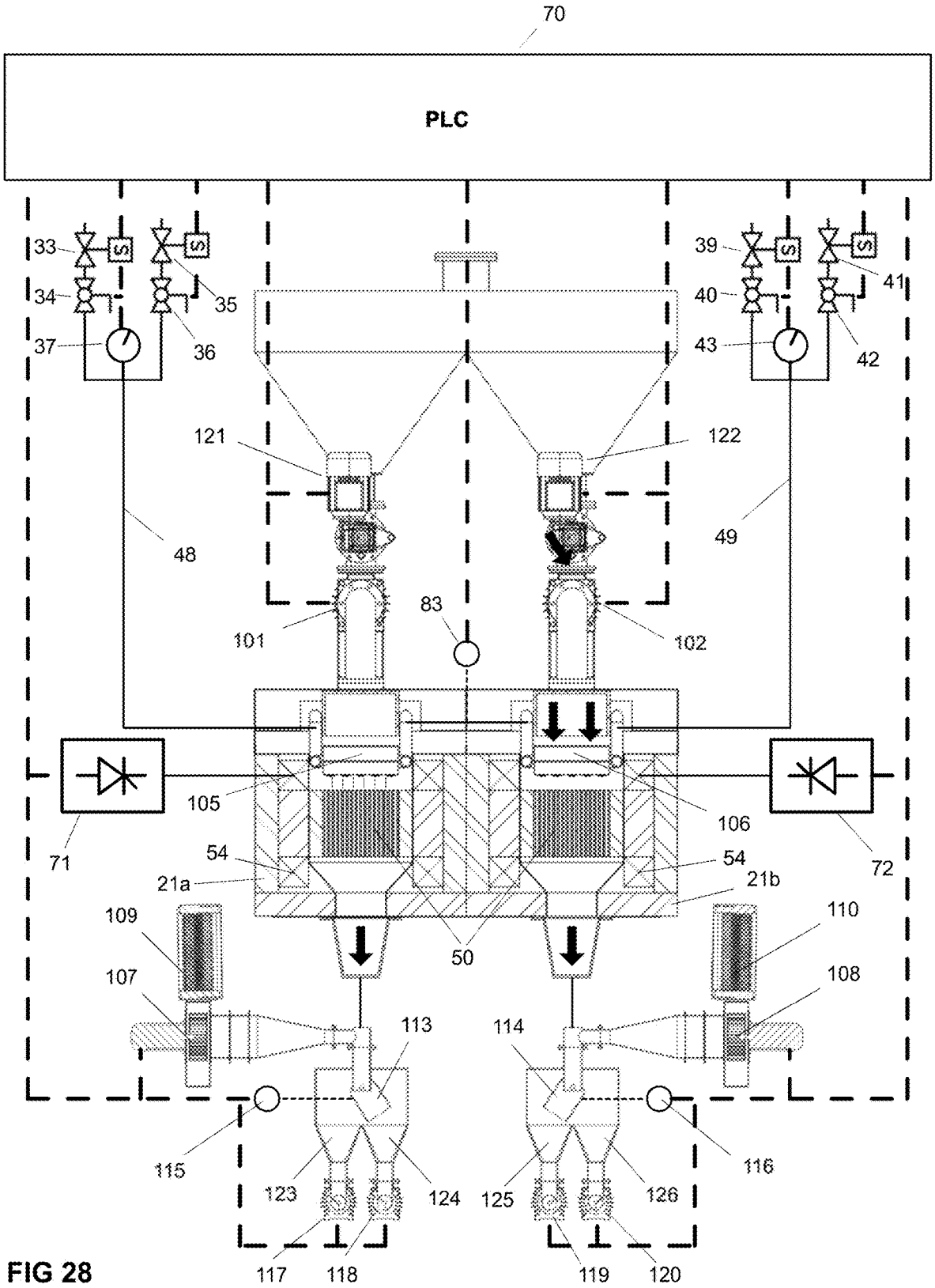
FIG. 28 shows a control scheme for the magnetic separator of FIG. 24.

FIG. 28 shows one example of a control scheme for a magnetic separator 92. As seen in the illustrated example, operation of the magnetic separator 92, may again be controlled by the PLC 70, which is in signal communication with rotary valve actuators 121/122, dosing screws 101/102, reciprocating actuator 83; fans 107/108; two-position actuators 115/116; discharge screws 117/118/119/120; switching valves 33/35/39/41, and power supplies 71/72 for the electromagnetic coils 54. In the example shown in FIG. 28, regulating valves 34/36/40/42 and pressure valves 37/43 are also controlled by PLC 70; however, in some examples the regulating valves and/or pressure valves may each be manually controlled or adapted for both manual and PLC control.

In operation, the PLC 70 controls the actuator 115 to move the chute 113 to a first position aligning with the first funnel 123 and discharge screw 117, and controls the actuator 121 to turn rotary valve 99 to an on-state while keeping rotary valve 100 in an off-state. In the on-state, rotary valve 99 conveys a dry material feed flow to the dosing screw 101 and magnetic sieve 21*a*, where a magnetic field is present in the magnetic matrix 50 therein, via a power source 71 that energizes electromagnetic coils 54. The air nozzle 105 ejects a low pressure airflow into the magnetic matrix 50 to promote passage of the dry material feed flow therethrough, while the exhaust fan 107 drives an air flow into the funnel 22 to generate a negative pressure below the magnetic matrix 50, thereby generating complimenting push-and-pull forces that promote a smooth laminar flow of fine dry material feed flow through the magnetic matrix 50.

As the dry feed flow passes through the gaps 56 of the magnetic matrix 50, magnetic particles adhere to ridges on the surface of the magnetized grooved plates 55, while non-magnetic particles pass fully through the magnetic matrix 50, and flow down to a distributor 111. With the chute 113 oriented in the first position, the dry material feed flow passes through the first funnel 123 and into the first discharge screw 117, for discharge as a non-magnetic product.

After a preset time or the passage of a preset amount of dry material feed flow, the PLC 70 controls the actuator 121 to turn the rotary valve 99 to an off-state, and controls the actuator 122 to turn the rotary valve 100 to an on-state, thereby causing the dry material feed flow to pass through dosing screw 102 and into magnetic sieve 21*b* where a similar non-magnetic separation process as discussed above is performed via the magnetic sieve 21*b*, the further arrangement of funnel 23, exhaust fan 108, distributor 112, chute 114, first opening 125, and first discharge screw 119.

Upon switching the dry material feed flow to magnetic sieve 21*b*, the PLC 70 controls the actuator 115 to switch the chute 113 to the second position, and reduces power to the power supply 71 to effectively reduce the strength of the magnetic field magnetic sieve 21*a*. The PLC 70 then controls the air nozzle 105 to eject an airflow into the gaps 56 of the magnetic matrix 50 to discharge magnetic particles that were adhered to the surfaces of the grooved plates 55 by the magnetic field, with the magnetic particles then passing together with the air flow from nozzle 105 down through funnel 22, into distributor 111, through chute 113 and into the second funnel 124 for discharge by the second discharge screw 118 as a magnetic product.

After a preset time or the passage of a preset amount of dry material feed flow, the PLC 70 controls the actuator 122 to turn the rotary valve 100 to an off-state, and controls the actuator 121 to turn the rotary valve 99 to an on-state, thereby causing the dry material feed flow to again pass through dosing screw 101 and into magnetic sieve 21*a* where a non-magnetic separation process is again performed. At this time, a magnetic product discharge operation similar to that discussed above is then performed in magnetic sieve 21*b*, via the arrangement of funnel 23, exhaust fan 108, distributor 112, chute 114, second funnel 126, and second discharge screw 120. Cyclic switching between magnetic and non-magnetic separation processes, at magnetic sieves 21*a*/21*b*, can be repeated indefinitely.

It is noted that the timing for controlling the magnetic separator 92 is the same as the timing for controlling magnetic separators discussed previously, with the exception that the discharge cycles (e.g., the flushing cycles) the example shown in FIGS. 24-27 include first and second stages that have only a single mode of operation. In these examples, the magnetic separator 92 will not output a middling product flushing, as the air flows generated by the air nozzles 105/106 and fans 107/108 remove such middling products during the feeding cycle. Thus, whereas flushing cycles executed in other magnetic separators include both a first mode operation for middling product flushing and a second mode operation for magnetic product flushing, the magnetic separator 92 has only a single mode of operation in each flushing stage for removing magnetic products. In each stage of a flushing cycle of the magnetic separator 92, power to the electromagnetic coils 54 is reduced (or eliminated) at the beginning of the flushing stage, and the compressed air flow is passed through the respective magnetic matrix to discharge magnetic particles that were previously adhered to the matrix 50 by the presence of a magnetic field. Near the end of each flushing stage, power is returned to the electromagnetic coils 54 to again generate a magnetic field in the corresponding magnetic matrix 50 in preparation for the next feed stage in the feeding cycle.

Figure 29:
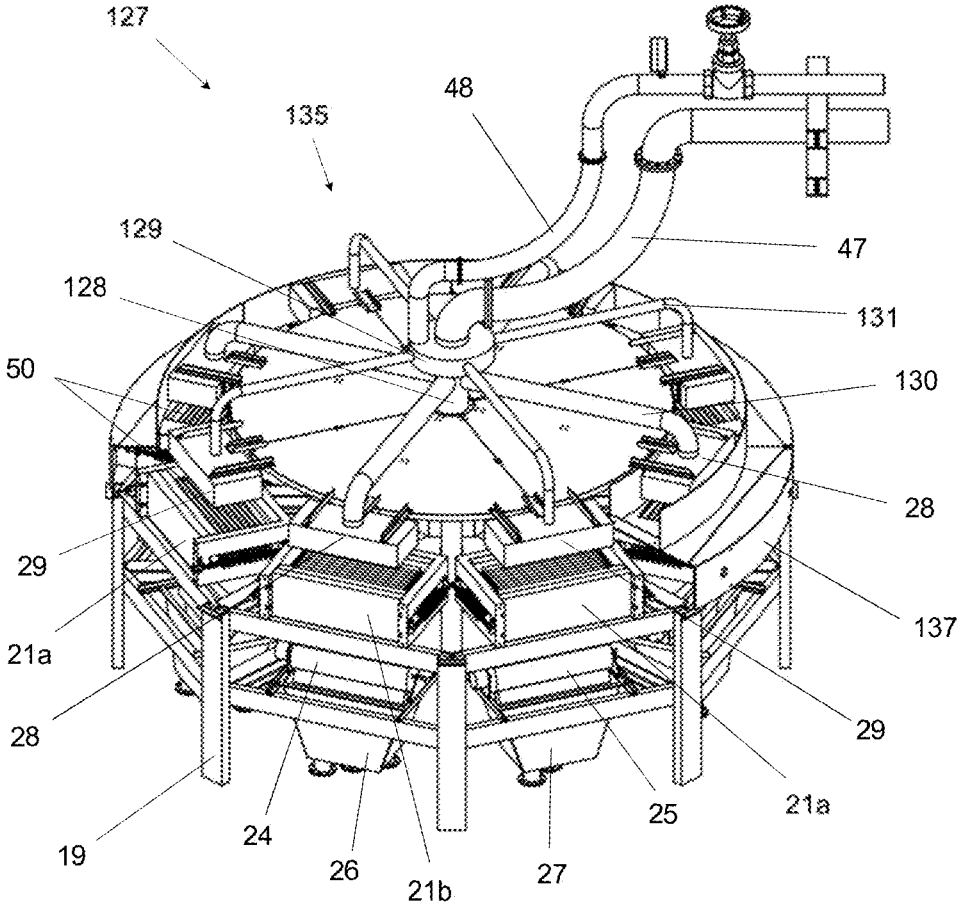
FIG. 29 shows an assembly of multiple magnetic separators of the present invention.
Figure 30:
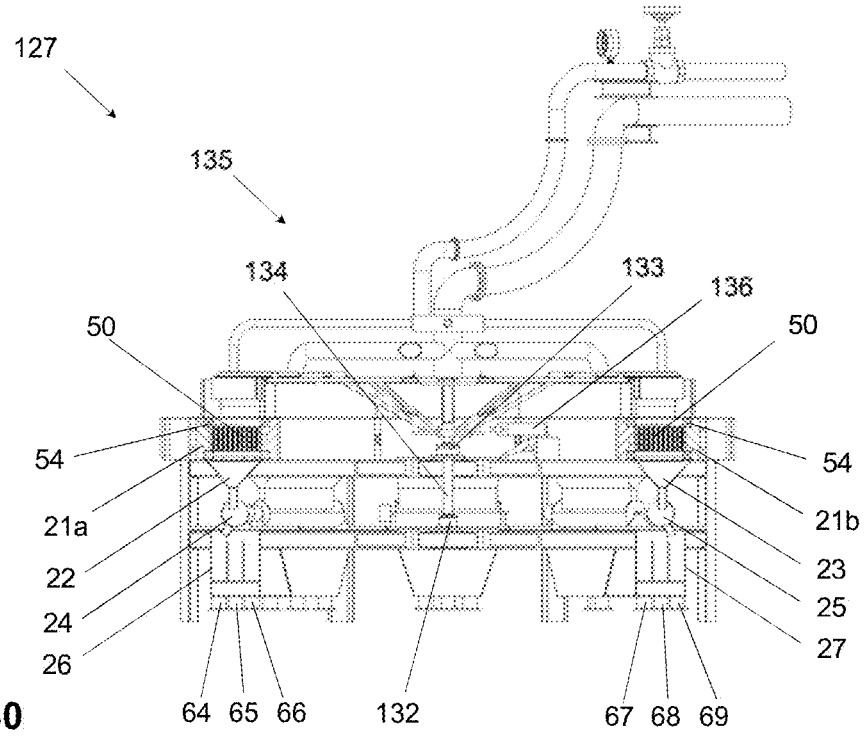
FIG. 30 shows a side elevation cross-section view of the assembly of FIG. 29.

Multiple individual magnetic separators according to this invention may also be combined with one another to form a magnetic separator assembly, with each of the individual magnetic separators being operated in parallel with one another. FIGS. 29-30 show one example of such a magnetic separator assembly 127 that comprises four separate magnetic separators, each comprising two magnetic sieves, for a total of eight magnetic sieves.

In the illustrated example, assembly 127 is adapted from magnetic separators 18'. In the magnetic separator 18, discussed previously, there are provided two magnetic sieves 21*a*/21*b* that are positioned linearly adjacent one another, with the lengthwise axes of the magnetic sieves 21*a*/21*b* oriented in parallel to one another. Assembly 127 comprises magnetic separators 18' that are slightly modified such that the individual magnetic sieves 21*a*/21*b* are again positioned adjacent one another, though with the lengthwise axes thereof oriented circumferentially with one another such that adjacent positioning of the four magnetic separators 18' forms a circular arrangement of the magnetic sieves 21*a*/21*b*. In the illustrated example, once circumferentially aligned, an outer housing 137 may be provided around the several magnetic separators 18' for preventing unintended spillage of the material flows fed therethrough and as protection from contaminants entering into the assembly.

As with the magnetic separator 18, each of the magnetic sieves 21*a*/21*b* is supported on a platform 19 with a corresponding funnel 22/23 provided thereunder for directing material flows to a respective distributor 24/25 for feeding output products to respective chutes 26/27. Similar to magnetic separator 18, there is provided a diffusor 20 supported above the platform 19, the diffuser comprising ejectors 28/29 in the form of feed inlets 28 and flush inlets 29. A slurry line 31 is in fluid communication with the feed inlets 28 through a flexible hose 47 and a central feed pipe 128 that splits into four radial feed pipes 130, each leading to a respective feed inlet 28. A flushing manifold 32 is in fluid communication with the flush inlets 29 through a flexible hose 48 and a central flush pipe 129 that splits into four radial flush pipes 131, each leading to a respective flush inlet 29.

In operation, the assembled magnetic separators 18' of the assembly 127 are operated in similar fashion to an individual magnetic separator 18, with feed inlet 28 being switched between magnetic sieves 21*a*/21*b* for performing first and second stages of successive feeding cycles, and flush inlet 29 being switched between magnetic sieves 21*a*/21*b* for performing first and second flush cycles. However, in assembly 127, the ejectors 28/29 are each rotated circumferentially around a central axle 134. The ejectors 28/29 are provided in a rotary diffusor 135, with the diffusor supported on the axis 134, which is held in place and allowed to turn by means of house bearings 132 and 133. With this assembly, the PLC 70 may control rotation of the ejectors 28/29 via a two-position actuator 136.

In a first method, the ejectors 28/29 may move in reciprocating circumferential movements, where a single ejector 28/29 moves once in a first circumferential direction (e.g., clockwise) and once in an opposite second circumferential direction (e.g., counterclockwise), such that each ejector 28/29 services only two magnetic sieves 21*a*/21*b* in the assembly 127. In this method, a feed inlet 28 may provide a feeding stage operation to a first magnetic sieve 21*a* and then be rotated circumferentially by a single position in the first circumferential direction to provide a feeding stage operation to a second magnetic sieve 21*b* that is circumferentially adjacent to the first magnetic sieve 21*a*. As a feed inlet 28 rotates away from a first magnetic sieve 21*a*, an adjacent flush inlet 29 rotates to the first magnetic sieve 21*a* and provide a flushing stage operation thereto. Thereafter, both ejectors 28/29 are rotated circumferentially by a single position in the second circumferential direction to again provide a feeding stage operation to the first magnetic sieve 21*a*, and flush inlet 29 is likewise rotated in the second circumferential direction to provide a flushing stage operation to a magnetic sieve 21*b* that was subjected to a feeding stage operation by another feed inlet 28 at an opposite side thereof. In this way, each magnetic sieve 21*a*/21*b* in the assembly 127 is subjected to a series of successive feed and flush operations by a dedicated pair of ejectors 28/29, with corresponding control over the magnetic sieves and material flow components thereunder as discussed above.

In a second method, all ejectors 28/29 may rotate in a single circumferential direction (e.g., clockwise or counter-clockwise), making complete rotations around the assembly 127, with each ejector 28/29 servicing each magnetic sieve 21*a*/21*b* once in a complete rotation. In this method, a feed inlet 28 may provide a feeding stage operation to a first magnetic sieve 21*a* and then be rotated circumferentially by a single position to provide a feeding stage operation to a second magnetic sieve 21*b* that is circumferentially adjacent to the first magnetic sieve 21*a*. As a feed inlet 28 rotates away from a first magnetic sieve 21*a*, an adjacent flush inlet 29 is rotated to the first magnetic sieve 21*a* and provides a flushing stage operation thereto. In this way, each magnetic sieve 21*a*/21*b* in the assembly 127 is subjected to a series of successive feed and flush operations by each of the ejectors 28/29, with corresponding control over the magnetic sieves and material flow components thereunder as discussed above. In this second method, the two-position actuator 136 is replaced with a continuous rotation actuator for 360° rotation of the rotary diffusor 135.

Figure 31:
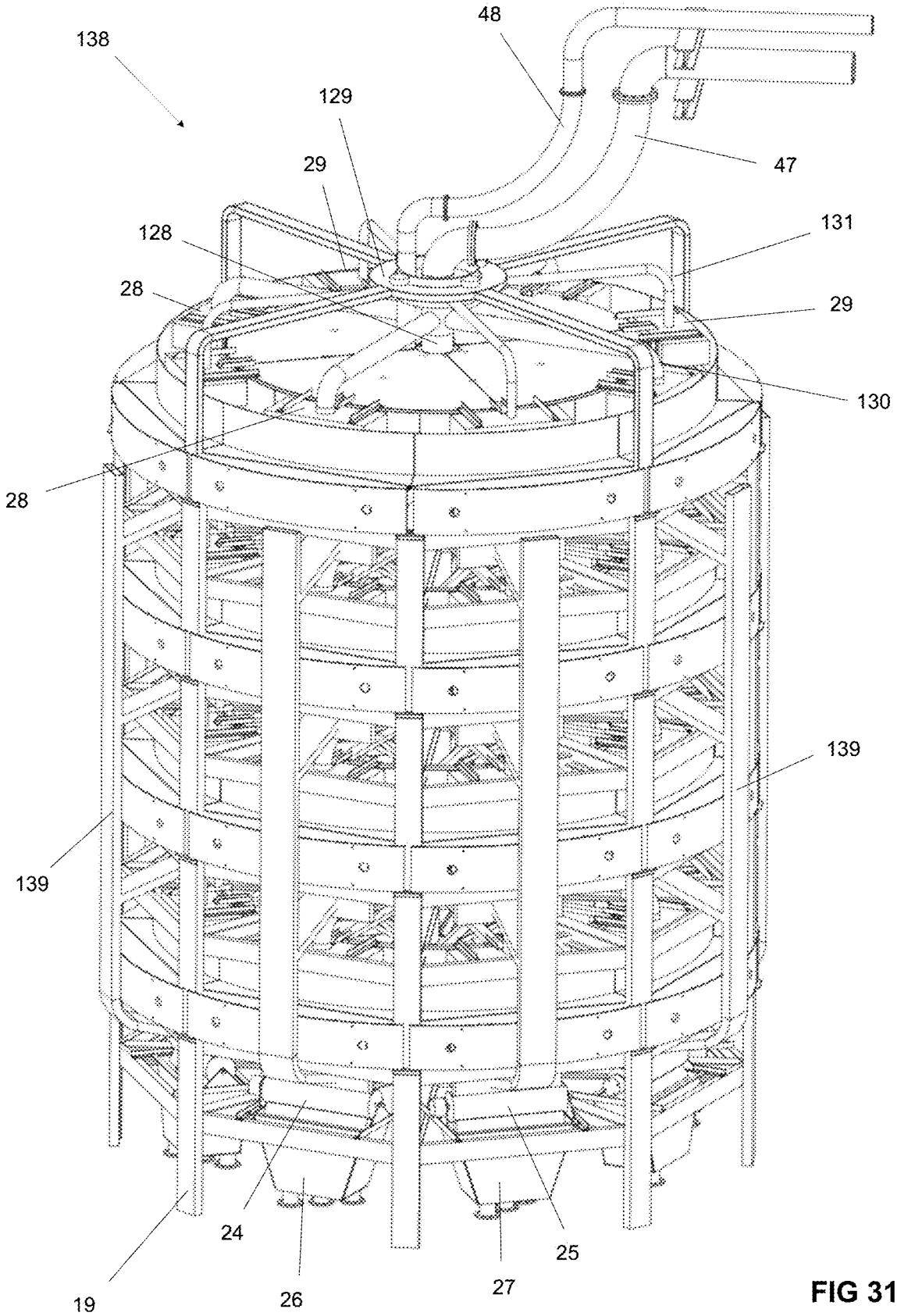
FIG. 31 shows a multi-tier assembly made of multiple assemblies of FIG. 29.
Figure 32:
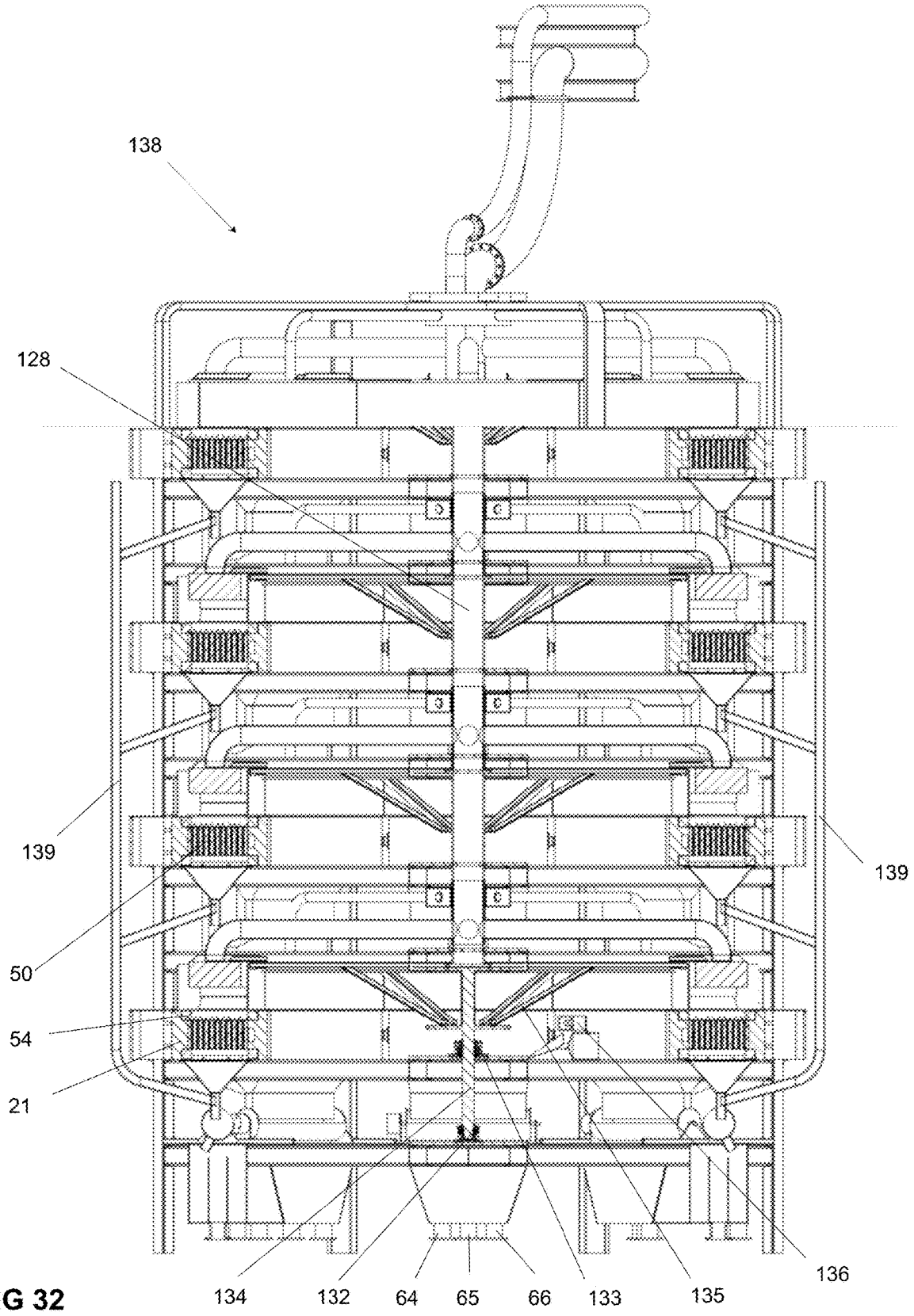
FIG. 32 shows a side elevation the multi-tier assembly of FIG. 31.

Multiple magnetic separator assemblies according to this invention may also be combined with one another, e.g., in a stacked configuration, to form a multi-tier magnetic separator assembly. FIGS. 31-32 show one example of such a multi-tier magnetic separator assembly 138 that comprises four separate tiers of magnetic separator assemblies, each comprising four magnetic separators with two magnetic sieves a piece, for a total of thirty-two magnetic sieves.

In operation, each tier of the multi-tier assembly 138 may operate in the same manner as described previously for a single tier assembly 127, with the exception that each tier of assemblies 127 shares common material feed components. That is, as shown in FIG. 32, a set of vertically stacked sieves 21*a*/21*b* each share a common distributor 24/25 for feeding output products to respective chute 26/27, with the magnetic sieve 21*a*/21*b* in the lowest tier having a funnel 22/23 that feeds directly into a corresponding distributor 24/25 while the magnetic sieves 21*a*/21*b* at higher tiers have funnels 22/23 that each feed into a common collection pipe 139 that directs material flows from those higher tier sieves 21*a*/21*b* to the corresponding distributor 24/25.

In operation, it is preferable that each tier of the multi-tier assembly 138 be operated in coordination with one another such that a material feed flow ejected from each set of vertically aligned magnetic sieves 21*a*/21*b* corresponds with one another for proper discharge through a common distributor 24/25 to a designated channel in a corresponding chute 26/27. This coordinated control can be achieved by driving each tier of the multi-tier assembly with a common axle 134, with ejectors 28/29 provided in a rotary diffusor 135, the rotary diffusor being supported on the axis 134, which is held in place and allowed to turn by means of house bearings 132 and 133, with rotation of the ejectors 28/29 being controlled by the PLC 70 via the two-position actuator 136.

A benefit of magnetic separators according to the present invention is that they make use of stationary magnetic matrices, thereby opening a wide range of applications by providing immediate and straightforward access to the magnetic matrix. With this, magnetic separators according to the present invention provide high intensity systems, in which the heaviest components are stationary and the moving parts are substantially lighter. This eliminates the need to rotate very heavy rotors, and the application of high workloads on gearboxes and shafts to overcome strong magnetic forces. This also enables magnetic separators according to the present invention to deliver higher production, with lower power consumption, lower investment, and lower maintenance costs, while enabling continuous operation and improved process control over the magnetic separation processes.

Magnetic separators according to the present invention are also easily adaptable for use as building blocks in the constructions of larger assemblies in several shapes and sizes. For example, FIGS. 29-30, show a single-tier assembly in which four separate magnetic separators 18' are arranged in a circular configuration; and FIGS. 31-32 show a second assembly in which four single-tier assemblies are stacked atop one another to yield a multi-tier assembly in which thirty-two separate magnetic separators 18' are arranged in a pillar configuration. In both assemblies, a single PLC 70 may be used to run all required software to emulate the entire operational process, including control of all magnetic fields, actuators, distributors, and etc. in performing magnetic separation processes based on the principles discussed above. The present invention provides magnetic separators that enable the separation of magnetic and non-magnetic particles without the costly and troublesome mechanical solution required by conventional systems, while at the same time enabling the use of this technology to separate materials that could not effectively be handled by conventional systems. Magnetic separators according to the present invention may also be adapted, through programming of the PLC 70, for a user to freely choose a duration of each individual process step independently, providing yet further flexibility in adapting the systems to multiple variations in process control, enabling use of the system for new applications as needed, while increasing efficiency of the magnetic separation processes in ways that were heretofore impossible to realize.

Although the present invention is described with reference to particular embodiments, it will be understood to those skilled in the art that the foregoing disclosure addresses exemplary embodiments only; that the scope of the invention is not limited to the disclosed embodiments; and that the scope of the invention may encompass additional embodiments embracing various changes and modifications relative to the examples disclosed herein without departing from the scope of the invention as defined in the appended claims and equivalents thereto.

To the extent necessary to understand or complete the disclosure of the present invention, all publications, patents, and patent applications mentioned herein are expressly incorporated by reference herein to the same extent as though each were individually so incorporated. No license, express or implied, is granted to any patent incorporated herein.

The present invention is not limited to the exemplary embodiments illustrated herein, but is instead characterized by the appended claims, which in no way limit the scope of the disclosure.

What is claimed is:

1. A magnetic separator comprising:

at least one pair of magnetic sieves, comprising a first magnetic sieve and a second magnetic sieve, supported in stationary positions on a static platform;

at least one pair of flow distributors, comprising a first distributor in a downstream flow of the first magnetic sieve and a second distributor in a downstream flow of the second magnetic sieve;

a material flow diffusor for supplying a material feed flow from a material supply line and a flushing fluid flow from a flushing manifold, the material flow diffusor being configured to supply the material feed flow and the flushing fluid flow to both the first magnetic sieve and the second magnetic sieve; and a controller configured to:

feed a material feed flow to the pair of magnetic sieves during a production run for separating magnetic and non-magnetic components in the material feed flow, with the material feed flow being fed to the pair of magnetic sieves in a continuous flow, and to switch the material feed flow between the first magnetic sieve and the second magnetic sieve without interrupting the continuous flow;

control a power supply to the pair of magnetic sieves for generating magnetic fields within the pair of magnetic sieves for separation of magnetic and non-magnetic components in a material feed flow that is fed to the pair of magnetic sieves;

control the flow distributors to switch each flow distributor between a first output position for discharging a non-magnetic product flow and a second position for discharging a magnetic product flow.

2. The magnetic separator according to claim 1, wherein:

the controller is configured to control the material feed flow to flow to only one of the first magnetic sieve and the second magnetic sieve.

3. The magnetic separator according to claim 1, wherein:

the controller is configured to control the material feed flow to switch between the first magnetic sieve and the second magnetic sieve while maintaining a constant flow rate of the continuous flow.

4. The magnetic separator according to claim 1, wherein:

the controller is configured to control the pair of magnetic sieves such that one magnetic sieve performs magnetic separation in a feeding operation and the other magnetic sieve performs product purging in a flushing operation to purge separated material in the absence of a material feed flow, with the magnetic separation in the one magnetic sieve and the product purging in the other magnetic sieve being performed in parallel with one another.

5. The magnetic separator according to claim 1, further comprising:

at least one product receptacle in a downstream flow with at least one of the first and second flow distributors for receiving material flows from the at least one flow distributor, the product receptacle comprising a first section for receiving non-magnetic product and a second section for receiving magnetic product.

6. The magnetic separator according to claim 1, further comprising:

at least one pair of product receptacles comprising a first product receptacle in a downstream flow with the first flow distributor and a second product receptacle in a downstream flow with the second flow distributor, the first and second product receptacles each comprising a first section for receiving non-magnetic product and a second section for receiving magnetic product.

7. A magnetic separator assembly, comprising a plurality of magnetic separators according to claim 1.

8. A magnetic separator comprising:

at least one pair of magnetic sieves, comprising a first magnetic sieve and a second magnetic sieve, supported in stationary positions on a static platform;

at least one pair of flow distributors, comprising a first distributor in a downstream flow of the first magnetic sieve and a second distributor in a downstream flow of the second magnetic sieve;

a material flow diffusor for supplying a material feed flow from a material supply line and a flushing fluid flow from a flushing manifold, the material flow diffusor being configured to supply the material feed flow and the flushing fluid flow to both the first magnetic sieve and the second magnetic sieve; and a controller configured to:

feed a material feed flow to the pair of magnetic sieves during a production run for separating magnetic and non-magnetic components in the material feed flow, with the material feed flow being fed to the pair of magnetic sieves in a continuous flow, and to switch the material feed flow between the first magnetic sieve and the second magnetic sieve without interrupting the continuous flow;

control a power supply to the pair of magnetic sieves for generating magnetic fields within the pair of magnetic sieves for separation of magnetic and non-magnetic components in a material feed flow that is fed to the pair of magnetic sieves;

control the flow distributors to switch each flow distributor between a first output position for discharging a non-magnetic product flow and a second position for discharging a magnetic product flow wherein, the controller is configured to control the pair of magnetic sieves such that one magnetic sieve performs magnetic separation in a feeding operation and the other magnetic sieve performs product purging in a flushing operation to purge separated material in the absence of a material feed flow, with the magnetic separation in the one magnetic sieve and the product purging in the other magnetic sieve being performed in parallel with one another, and wherein the controller is configured to control the power supply to the pair of magnetic sieves such that:

one magnetic sieve receiving the material feed flow for performing magnetic separation is provided with sufficient power to generate a magnetic field suitable for separating magnetic components in the material feed flow from non-magnetic components in the material feed flow; and another magnetic sieve receiving the flushing fluid flow for performing product purging is provided with a relatively lesser power than that provided to the one magnetic sieve to enable purging of magnetic components by the flushing fluid flow.

9. The magnetic separator according to claim 8, wherein:

the controller is configured to control the power supply to the pair of magnetic sieves such that, prior to switching the material feed flow from one magnetic sieve to another, a power supply to the other magnetic sieve is increased to provide sufficient power to generate a magnetic field in the other magnetic sieve suitable for separating magnetic and non-magnetic components in the material feed flow; and after switching the material feed flow from the one magnetic sieve to the other, decreasing a power supply to the one magnetic sieve to sufficiently reduce a magnetic field in the one magnetic sieve to enable purging of magnetic components by a flushing fluid flow.

10. The magnetic separator according to claim 9, wherein:

the controller is configured to eliminate a power supply to the magnetic sieve receiving the flushing fluid flow for performing product purging.

11. The magnetic separator according to claim 9, wherein:

the controller is configured to reverse the polarity of a power supply to the magnetic sieve receiving the flushing fluid flow for performing product purging, in order to decrease a time for reducing the magnetic field in the magnetic sieve.

12. A magnetic separator comprising at least one pair of magnetic sieves, comprising a first magnetic sieve and a second magnetic sieve, supported in stationary positions on a static platform;

at least one pair of flow distributors, comprising a first distributor in a downstream flow of the first magnetic sieve and a second distributor in a downstream flow of the second magnetic sieve;

a material flow diffusor for supplying a material feed flow from a material supply line and a flushing fluid flow from a flushing manifold, the material flow diffusor being configured to supply the material feed flow and the flushing fluid flow to both the first magnetic sieve and the second magnetic sieve; and a controller configured to:

feed a material feed flow to the pair of magnetic sieves during a production run for separating magnetic and non-magnetic components in the material feed flow, with the material feed flow being fed to the pair of magnetic sieves in a continuous flow, and to switch the material feed flow between the first magnetic sieve and the second magnetic sieve without interrupting the continuous flow;

control a power supply to the pair of magnetic sieves for generating magnetic fields within the pair of magnetic sieves for separation of magnetic and non-magnetic components in a material feed flow that is fed to the pair of magnetic sieves;

control the flow distributors to switch each flow distributor between a first output position for discharging a non-magnetic product flow and a second position for discharging a magnetic product flow, wherein the material flow diffusor comprises a feed inlet in a downstream flow with the material supply line for receiving a material feed flow, the feed inlet being movable between a first position for dispensing a material feed flow to the first magnetic sieve and a second position for dispensing a material feed flow to the second magnetic sieve, wherein, in the first position the feed inlet is positioned in line with a fluid flow path with the first magnetic sieve and displaced from a fluid flow path with the second magnetic sieve, and in the second position the feed inlet is positioned in line with the fluid flow path with the second magnetic sieve and displaced from the fluid flow path with the first magnetic sieve.

13. The magnetic separator according to claim 12, wherein:

the feed inlet is supported on a pair of tracks, and the controller is configured to command an actuator for moving the feed inlet along the pair of tracks, between the first and second positions, to switch a material feed flow between the first magnetic sieve and the second magnetic sieve.

14. The magnetic separator according to claim 12, wherein:

the material flow diffusor comprises a pair of flush inlets in downstream flow with the flushing manifold for receiving a flushing fluid flow, the pair of flush inlets being movable between first and second positions; and the controller is configured to command an actuator for moving the pair of flush inlets between the first and second positions for executing flushing operations to purge material from the pair of magnetic sieves.

15. The magnetic separator according to claim 14, wherein:

the pair of flush inlets comprise a first flush inlet and a second flush inlet, in the first position the first flush inlet is positioned for dispensing a flushing fluid flow to the first magnetic sieve, and in the second position the second flush inlet is positioned for dispensing a flushing fluid flow to the second magnetic sieve; and the controller is configured to command an actuator for moving the pair of flush inlets between the first and second positions for executing flushing operations to purge material from the pair of magnetic sieves.

16. The magnetic separator according to claim 15, wherein:

the feed inlet and the pair of flush inlets are supported on a pair of tracks, and each is reciprocally movable along the tracks; and the controller is configured to command an actuator for moving the feed inlet and pair of flush inlets along the tracks such that:

in a first position, the feed inlet is positioned for dispensing a material feed flow to the first magnetic sieve, and the second flush inlet is positioned for dispensing a flushing fluid flow to the second magnetic sieve, and in a second position, the feed inlet is positioned for dispensing a material feed flow to the second magnetic sieve, and the first flush inlet is positioned for dispensing a flushing fluid flow to the first magnetic sieve.

17. The magnetic separator according to claim 12, wherein:

the material flow diffusor comprises a pair of flush inlets in downstream flow with the flushing manifold for receiving a flushing fluid flow, the pair of flush inlets comprising a first flush inlet and a second flush inlet, with the first flush inlet movable along a length of the first magnetic sieve and the second flush inlet movable along a length of the second magnetic sieve; and the controller is configured to command an actuator for moving the pair of flush inlets along lengths of the respective magnetic sieves to execute flushing operations to purge material from the pair of magnetic sieves.

18. The magnetic separator according to claim 17, wherein:

the pair of flush inlets are supported on respective support arms and suspended over respective openings to the corresponding magnetic sieves; and the controller is configured to command an actuator to reciprocally move the pairs of support arms along lengths of the respective magnetic sieves to execute the flushing operations.

19. The magnetic separator according to claim 12, wherein:

the controller is configured to control the material feed flow to switch between the first magnetic sieve and the second magnetic sieve while maintaining a constant flow rate of the continuous flow.

20. A magnetic separator comprising:

at least one pair of magnetic sieves, comprising a first magnetic sieve and a second magnetic sieve, supported in stationary positions on a static platform;

at least one pair of flow distributors, comprising a first distributor in a downstream flow of the first magnetic sieve and a second distributor in a downstream flow of the second magnetic sieve;

a material flow diffusor for supplying a material feed flow from a material supply line and a flushing fluid flow from a flushing manifold, the material flow diffusor being configured to supply the material feed flow and the flushing fluid flow to both the first magnetic sieve and the second magnetic sieve; and a controller configured to:

feed a material feed flow to the pair of magnetic sieves during a production run for separating magnetic and non-magnetic components in the material feed flow, with the material feed flow being fed to the pair of magnetic sieves in a continuous flow, and to switch the material feed flow between the first magnetic sieve and the second magnetic sieve without interrupting the continuous flow;

control a power supply to the pair of magnetic sieves for generating magnetic fields within the pair of magnetic sieves for separation of magnetic and non-magnetic components in a material feed flow that is fed to the pair of magnetic sieves;

control the flow distributors to switch each flow distributor between a first output position for discharging a non-magnetic product flow and a second position for discharging a magnetic product flow, wherein the material flow diffusor comprises a silo in downstream flow with the material supply line for receiving a material feed flow, and a pair of feed inlets in downstream flow with the silo, the pair of feed inlets comprising a first feed inlet for dispensing a material feed flow to the first magnetic sieve and a second feed inlet for dispensing a material feed flow to the second magnetic sieve; and wherein the controller is configured to switch a material feed flow between the first magnetic sieve and the second magnetic sieve by controlling at least one actuator on the silo for changing the material feed flow between the first feed inlet and the second feed inlet.

21. The magnetic separator according to claim 20, wherein:

the material flow diffusor further comprises a pair of flush inlets in downstream flow with the flushing manifold for receiving a flushing fluid flow, the pair of flush inlets comprising a first flush inlet and a second flush inlet, with the first flush inlet movable along a length of the first magnetic sieve and the second flush inlet movable along a length of the second magnetic sieve; and the controller is configured to command an actuator for moving the pair of flush inlets along the lengths of the respective magnetic sieves to execute flushing operations to purge material from the pair of magnetic sieves.

22. The magnetic separator according to claim 21, wherein:

the pair of flush inlets are supported on respective support arms and suspended over respective openings to the corresponding magnetic sieves; and the controller is configured to command an actuator to reciprocally move the pairs of support arms along lengths of the respective magnetic sieves to execute the flushing operations.

23. The magnetic separator according to claim 20, wherein:

the silo comprises a movable silo chute in downstream flow with an output of the material supply line, the silo chute being movable between a first potion for directing a material feed flow to the first feed inlet and a second position for directing a material feed flow to the second feed inlet; and the controller is configured to command an actuator for moving the silo chute between the first position and the second position to switch a material feed flow between the first magnetic sieve and the second magnetic sieve.

24. The magnetic separator according to claim 20, wherein:

the silo comprises a first funnel having a first rotary valve and a second funnel having a second rotary valve; and the controller is configured to command an actuator to the first rotary valve for opening and closing a passage for a material feed flow through the first funnel, and to command an actuator to the second rotary valve for opening and closing a passage for a material feed flow through the second funnel, the controller being programmed to control the respective actuators of the first and second rotary valves to open a passage through only one of the first and second funnels at a time.

25. The magnetic separator according to claim 24, wherein:

a first dosing mechanism is provided downstream of the first rotary valve, the first dosing mechanism being adapted to control a dosing rate of a material feed flow to the first feed inlet for dispensing to the first magnetic sieve;

a second dosing mechanism is provided downstream of the second rotary valve, the second dosing mechanism being adapted to control a dosing rate of a material feed flow to the second feed inlet for dispensing to the second magnetic sieve; and the controller is configured, when commanding an actuator of a rotary valve to move the corresponding rotary valve to an open state, to control a dosing rate of the corresponding dosing mechanism downstream of the respective rotary valve.

26. The magnetic sieve according to claim 20, wherein the material flow diffusor further comprises a pair of flush inlets in downstream flow with the flushing manifold for receiving a flushing fluid flow, the pair of flush inlets comprising a first air nozzle for injecting an airflow into the first magnetic sieve and a second air nozzle for injecting an airflow into the second magnetic sieve; and the controller is configured, when directing a material feed flow to a magnetic sieve, to command the corresponding air nozzle of the respective magnetic sieve to inject an air flow into the magnetic sieve for creating a pressure differential that promotes a flow of the material feed flow through the magnetic sieve.

27. The magnetic separator according to claim 20, wherein:

the first magnetic sieve comprises a first funnel in downstream flow with the first magnetic sieve for receiving a material feed flow output from the first magnetic sieve, and the second magnetic sieve comprises a second funnel in downstream flow with the second magnetic sieve for receiving a material feed flow output from the second magnetic sieve;

a first exhaust fan is provided in airflow communication with the first funnel for creating a negative pressure within the first funnel, and a second exhaust fan is provided for creating a negative pressure within the second funnel; and the controller is configured, when directing a material feed flow to a magnetic sieve, to command the corresponding exhaust fan downstream of the respective magnetic sieve to create a negative pressure within the corresponding funnel downstream of the magnetic sieve for creating a pressure differential that promotes a flow of the material feed flow through the magnetic sieve and into the funnel.

28. The magnetic separator according to claim 20, wherein:

the controller is configured to control the material feed flow to switch between the first magnetic sieve and the second magnetic sieve while maintaining a constant flow rate of the continuous flow.

29. A magnetic separator assembly comprising:

a plurality of magnetic separators, each magnetic separator comprising:

at least one pair of magnetic sieves, comprising a first magnetic sieve and a second magnetic sieve, supported in stationary positions on a static platform;

at least one pair of flow distributors, comprising a first distributor in a downstream flow of the first magnetic sieve and a second distributor in a downstream flow of the second magnetic sieve;

a material flow diffusor for supplying a material feed flow from a material supply line and a flushing fluid flow from a flushing manifold, the material flow diffusor being configured to supply the material feed flow and the flushing fluid flow to both the first magnetic sieve and the second magnetic sieve; and wherein one or more controllers are configured to control each of the magnetic separators to:

feed a material feed flow to the pair of magnetic sieves during a production run for separating magnetic and non-magnetic components in the material feed flow, with the material feed flow being fed to the pair of magnetic sieves in a continuous flow, and to switch the material feed flow between the first magnetic sieve and the second magnetic sieve without interrupting the continuous flow;

control a power supply to the pair of magnetic sieves for generating magnetic fields within the pair of magnetic sieves for separation of magnetic and non-magnetic components in a material feed flow that is fed to the pair of magnetic sieves;

control the flow distributors to switch each flow distributor between a first output position for discharging a non-magnetic product flow and a second position for discharging a magnetic product flow, wherein the plurality of magnetic separators are positioned adjacent one another, in a circular arrangement with feed inlets of the plurality of magnetic separators in downstream flow with a common material supply line and flush inlets of the plurality of magnetic separators in downstream flow with a common flushing manifold.

30. A multi-tier magnetic separator assembly, comprising a plurality of magnetic separator assemblies according to claim 29.

31. A multi-tier magnetic separator assembly according to claim 30, wherein the plurality of magnetic separator assemblies are stacked one atop another, with the feed inlets of the plurality of magnetic separators in downstream flow with a common material supply line and the flush inlets of the plurality of magnetic separators in downstream flow with a common flushing manifold.

32. The magnetic separator assembly according to claim 29, wherein:

the one or more controllers are configured to control each of the magnetic separators to control the material feed flow to switch between the first magnetic sieve and the second magnetic sieve while maintaining a constant flow rate of the continuous flow.

* * * * *